US008695310B2

(12) United States Patent
Tremblay

(10) Patent No.: US 8,695,310 B2
(45) Date of Patent: Apr. 15, 2014

(54) MODULAR BUILDING STRUCTURE

(75) Inventor: Jean-Robert Tremblay, Mont-Royal (CA)

(73) Assignee: 3088-7418 Quebec Inc., Mont-Royal, Quebec (CA)

( * ) Notice: Subject to any disclaimer, the term of this patent is extended or adjusted under 35 U.S.C. 154(b) by 600 days.

(21) Appl. No.: 11/886,572

(22) PCT Filed: Mar. 20, 2006

(86) PCT No.: PCT/CA2006/000427

§ 371 (c)(1),
(2), (4) Date: Sep. 18, 2007

(87) PCT Pub. No.: WO2006/096997

PCT Pub. Date: Sep. 21, 2006

(65) Prior Publication Data

US 2009/0013639 A1 Jan. 15, 2009

Related U.S. Application Data

(60) Provisional application No. 60/662,812, filed on Mar. 18, 2005.

(51) Int. Cl.
*E04B 1/61* (2006.01)
*E04C 2/34* (2006.01)

(52) U.S. Cl.
USPC ..... 52/775; 52/483.1

(58) Field of Classification Search
USPC ..... 52/167.3, 241, 293.3, 426, 479, 483.1, 52/486, 489.1, 651.1, 653.1, 762, 764, 52/770, 775, 781.3; 211/191, 192
See application file for complete search history.

(56) References Cited

U.S. PATENT DOCUMENTS

| | | | | |
|---|---|---|---|---|
| 3,591,993 | A | 7/1971 | Reeves | |
| 3,733,755 | A | 5/1973 | Butler | |
| 4,330,974 | A * | 5/1982 | Fleisch et al. | 52/489.1 |
| 4,648,216 | A | 3/1987 | Reaves et al. | |
| 4,794,744 | A | 1/1989 | Young et al. | |
| 4,980,998 | A * | 1/1991 | Amstutz et al. | 52/28 |
| 5,555,689 | A * | 9/1996 | Gilmore | 52/489.1 |
| 5,899,035 | A * | 5/1999 | Waalkes et al. | 52/239 |
| 6,330,773 | B1 * | 12/2001 | MacDonald et al. | 52/239 |
| 6,349,516 | B1 * | 2/2002 | Powell et al. | 52/239 |

FOREIGN PATENT DOCUMENTS

| | | |
|---|---|---|
| CA | 1290543 | 10/1991 |
| CA | 1302678 | 6/1992 |

* cited by examiner

*Primary Examiner* — Basil Katcheves
*Assistant Examiner* — Theodore Adamos
(74) *Attorney, Agent, or Firm* — Benoit & Côté Inc.

(57) ABSTRACT

The disclosure relates to a kit for building an exterior wall of a modular building structure. The kit comprises at least two substantially elongated posts and a wall panel for installing on the at least two posts. The wall panel includes a wall panel first attachment and a wall panel second attachment. The wall panel first and second attachments each includes an L-shaped wall panel attachment linking member, an attachment bracket post attachment portion, a wall panel attachment bracket and an attachment bracket spacing section.

20 Claims, 20 Drawing Sheets

14
348
362
360
356
358
72
78
350
354
348
352
353
348
362
340
360
358
356
364
90
94
14
340
346
342
94
92
420
341
420
94
14
344
346

14'
382

382
386
388
384
14'
226
14'

226
14'
14'

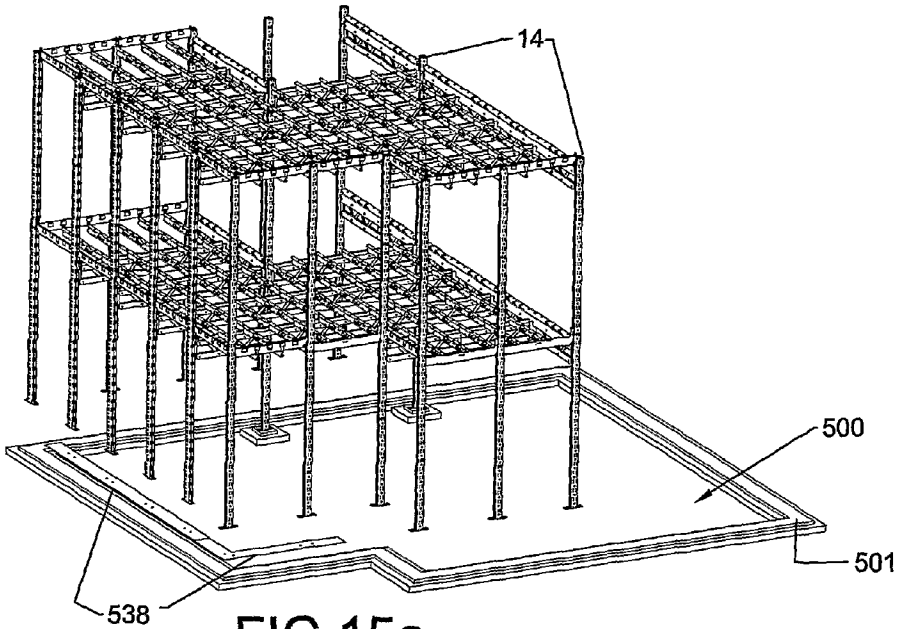
FIG 15a
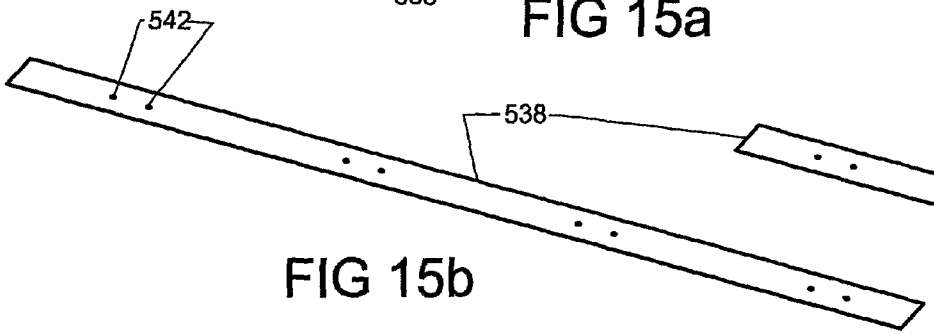
FIG 15b
FIG 15c

MODULAR BUILDING STRUCTURE

This application is the national stage of PCT patent application PCT/CA2006/000427 filed Mar. 20, 2006, which claims priority from US provisional patent application 60/662,812 filed Mar. 18, 2005, the specification of which is hereby incorporated herein by reference in its entirety.

FIELD OF THE INVENTION

The present invention relates to the general field of construction work, and is particularly concerned with a modular building structure.

BACKGROUND OF THE INVENTION

There are many types of modular building structures. These building structures usually take the form of a kit including components that may be assembled together at a construction site. However, such kits typically have only a limited number of parts and therefore only serve to assemble buildings according to a few simple blueprints. Furthermore, many currently existing kits have only limited structural rigidity so that the buildings that are assembled using these kits are typically relatively simple buildings, such as sheds.

In cases wherein a kit is used to assemble a building, there is often the need to add parts to the kit so that the building is fully finished. Therefore, advantages brought by a kit are mitigated by the fact that some traditional construction techniques typically have to be used. These construction techniques often require cutting pieces of wood and of other materials on a construction site. Therefore, there is a need to take measurements, with all associated risks of errors, and to cut a piece of material, which often leads to unusable relatively small remaining pieces of material that are thrown away. These traditional construction techniques are therefore relatively time consuming and generate relatively large quantities of wastes.

Furthermore, in currently existing buildings, whether assembled using a kit or using traditional construction techniques, there are typically many thermal bridges between an interior of the building and an exterior of the building. These thermal bridges occur because insulation is typically inserted between an internal wall and an external wall of the building. These internal and external walls are typically attached to studs. Therefore, no insulation is provided at the location where these studs are found and heat may then be transferred between inside and outside the building through these studs. The thermal bridges typically cause relatively large heat losses during winter and heat admission into the building during summer.

Against this background, there exists a need in the industry to provide a new and improved modular building structure.

An object of the present invention is therefore to provide an improved modular building structure.

SUMMARY OF THE INVENTION

In a first broad aspect, the invention provides a kit for building a modular building structure. The kit includes a wall panel having a wall panel body, the wall panel body defining a wall panel body first end and a substantially opposed wall panel body second end. The wall panel includes wall panel first and second attachments extending from the wall panel body and located respectively substantially adjacent the wall panel first end. The wall panel first and second attachments are spaced apart relative to each other by a predetermined distance. At least two substantially elongated posts, each including an attachment receiving section for receiving one of the wall panel first and second attachments are also provided. The kit further includes a substantially elongated post positioning member, the post positioning member defining substantially longitudinally opposed post positioning member first and second ends. The post positioning member includes a post positioning member first attachment located substantially adjacent the post positioning member first end and a post positioning member second attachment located substantially adjacent the post positioning member second end. The post positioning member first and second attachments are reversibly attachable to a respective one of the post at the attachment receiving section thereof. The post positioning member first and second attachments are spaced apart relative to each other by a predetermined distance. Attaching the post positioning member to the two posts when the two posts are substantially parallel to each other ensures that two posts are spaced apart relative to each other by a distance allowing to attach the wall panel to the two posts.

Advantageously, the kit allows to assemble a complete house without requiring the use of any measuring implements such as rulers and measuring tapes. Furthermore, all the components of the kit are dimensioned so that there is no need to cut any part to assemble a complete house. Therefore, a house is easily assembled using this kit in a relatively short amount of time.

Yet furthermore, using relatively tight manufacturing tolerances for the other various components of the kit allow to build a house that is relatively solid and that will not shift shape with time.

In some embodiments of the invention, external wall panels are attachable to the posts so as to be biasable towards each other to allow to achieve a relatively tight fitting between these panels. This tight fitting brings structural rigidity to the house.

In some embodiments of the invention, the external wall panels are attached to the posts in a spaced apart relationship relatively thereto. In these embodiments, insulation may be provided between internal walls of the house and the external wall panels. Also, insulation may be further provided between the external wall panels and the posts. Therefore, many thermal bridges between the interior of the house and the exterior of the house that exist in currently existing houses are eliminated.

The kit is conceived so as to be ergonomic and easily usable by users having only minimal experience in using the kit. Furthermore, the kit components are relatively inexpensive to manufacture so that using the kit to build a house is price-competitive with currently existing manners of building houses.

In another broad aspect, the invention provides a method for building a modular building structure onto a footing, the method comprising:

- providing a first post and positioning the first post relatively to the footing, the first post including an attachment section for attaching a house component thereto;
- providing a post positioning member and attaching the post positioning member to the first post;
- providing a second post and positioning the second post relatively to the footing, the second post including an attachment section for attaching the house component thereto, the second post being positioned such that the post positioning member is simultaneously attachable to said first and second posts;
- attaching the post positioning member to the second post;
- securing the first and second posts to the footing; and detaching the post positioning member from the first and second posts.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

In the appended drawings:

FIG. 15*a*, in a perspective view, illustrates the disposition of posts, main beams and auxiliary beams into the house of FIG. 1;

FIG. 15*b*, in a perspective view, illustrates a template for positioning the posts of FIG. 14*a;*

FIG. 15*c*, in a perspective view, illustrates another template for attaching the posts of FIG. 15*a*, the template being positionable at a corner of the house of FIG. 10.

DETAILED DESCRIPTION

Figure 1:
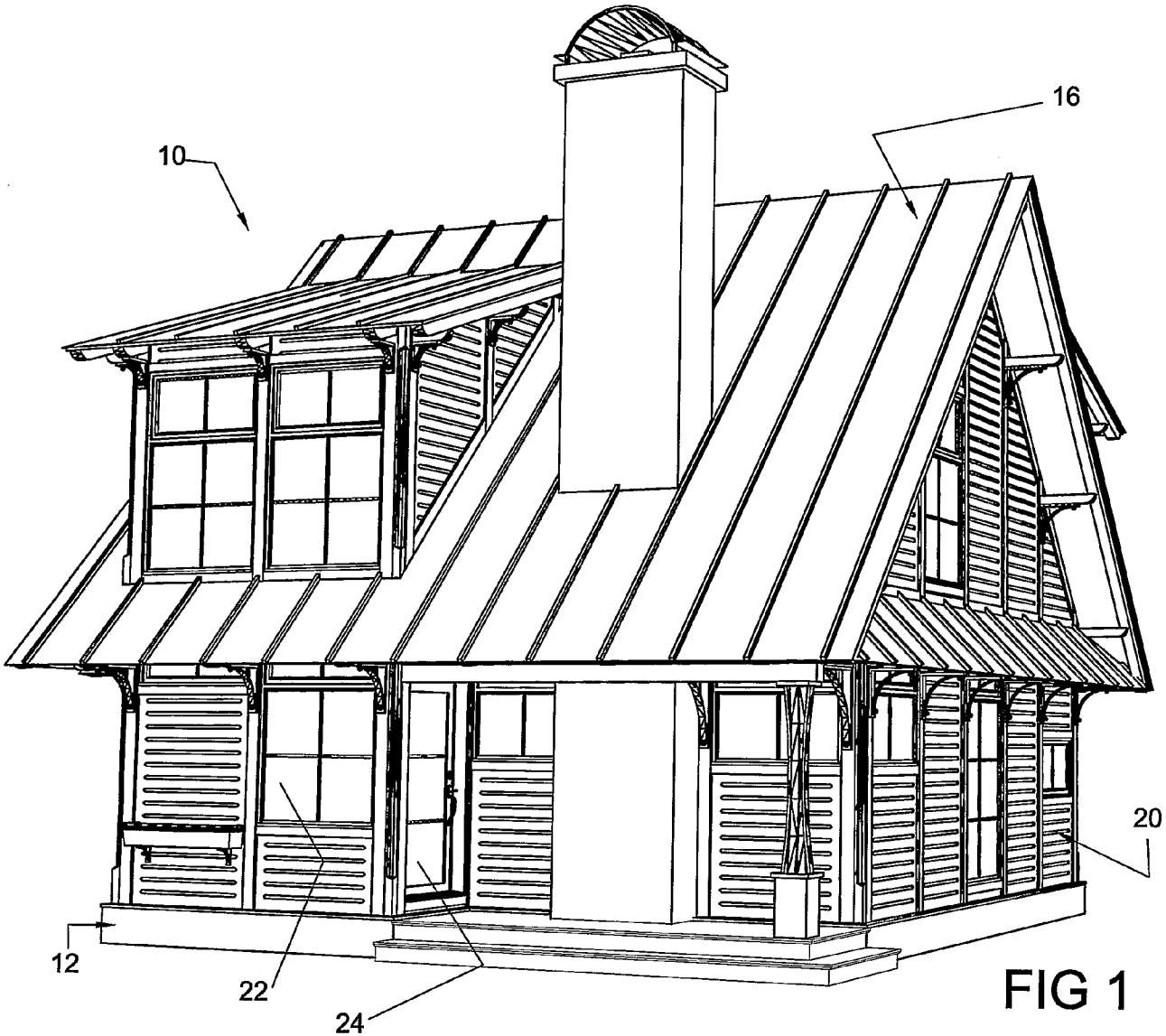
FIG. 1, in a perspective view, illustrates a house in accordance with an embodiment of the present invention.

FIG. 1 illustrates a house 10 in accordance with an embodiment of the present invention. The house 10 is assembled using a kit. Referring to FIG. 5*a*, the house 10 includes a foundation 12 and substantially vertical posts 14 extending substantially upwardly from the foundation 12. Returning to FIG. 1, a roof 16 is located at the top of the house 10 and attached to the posts 14. Floors 18 located intermediate the foundation 12 and the roof 16, the floors 18 being also attached to the posts 14. Walls 20 extend substantially outwardly from the posts 14 between the foundation 12 and the roof 16. Furthermore, the house 10 includes windows 22, doors 24 and stairs 26 (seen in FIG. 12).

In the present document, the house 10 is described using directional terms such as top, up, down, bottom and the like.

The reader skilled in the art will readily appreciate that these directional terms are used only to facilitate the description of the different components that make the house 10. However, these terms should not be used to restrict the scope of the present invention. Furthermore, terms internal and inward refer to directions directed toward the interior of the house 10 while terms such as external and outward define a direction directed toward the exterior of the house 10.

Although a specific house 10 including all the above-mentioned components is described in the present document, the reader skilled in the art will readily appreciate that it is also within the scope of the invention to have kits that include only some of the components so that less complex houses may be built. Similarly, it is also within the scope of the invention to have kits that include other components that are not mentioned hereinabove.

The reader skilled in the art will readily appreciate that while a kit for building a complete house 10 is described in the present specification, it is within the scope of the invention to use only part of the kit to assemble part of alternative houses or other buildings. Furthermore, the kit is also usable to assemble other modular building structures such as, for example, sheds, barns and larger buildings, or portions thereof.

Figure 12:
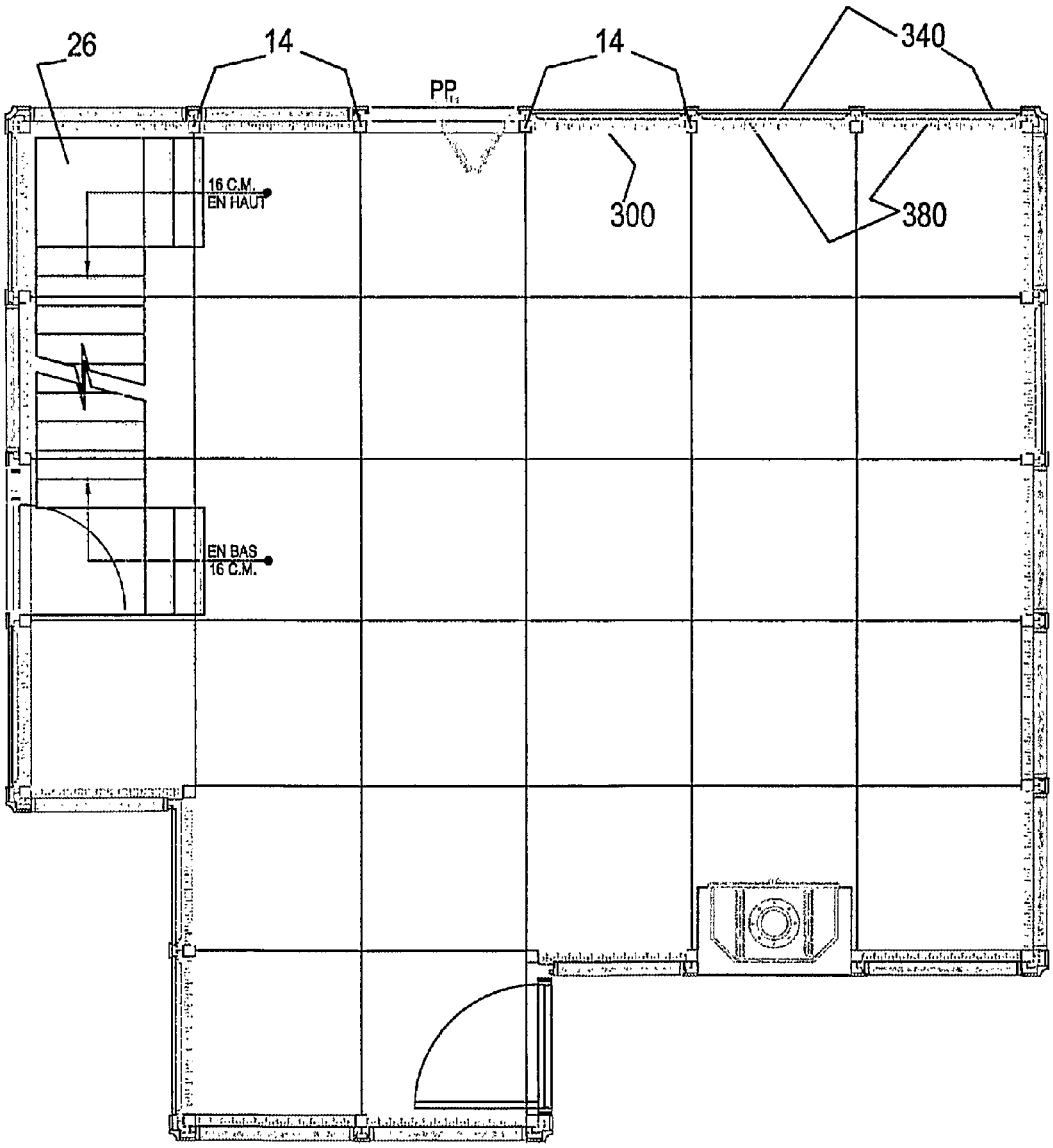
FIG. 12, in a top plan cross-sectional view illustrates the house of FIG. 1.

The various components of the kit are dimensioned so that they are readily attachable to the posts 14 when the posts 14 are attached to the foundation 12 according to a substantially uniform grid structure, as seen on FIG. 12. Therefore, there is no need to cut parts to assemble the house 10 using the kit according to the invention. However, it is within the scope of the invention to have kits similar to the kit described in this document in which some of the components need to be cut before being used.

The posts 14 are structural posts that allow attaching the rest of the structure of the house 12 thereto. The posts 14 are disposed at the periphery of the house 10. Furthermore, in houses 10 wherein posts disposed at the periphery of the house 10 are spaced apart by a distance that is relatively large, posts 14 are also disposed at the interior of the house 10 so that the structural integrity of the house 10 is improved.

FIGS. 2*a*-2*d*, the posts 14 include post members 60. The post members 60 are substantially elongated and include a post member first end 62 and a substantially longitudinally opposed post member second end 64. The post 60 has a substantially U-shaped cross-section and, as such, includes a post member first wall 66, a substantially opposed and parallel post member second wall 68 and a post member third wall 70 extending therebetween. The post member third wall 70 is substantially perpendicular to both the post member first and second walls 66 and 68. Attachment sections including attachment apertures 72, described in further details hereinbelow, extend through the post member first, second and third walls 66, 68 and 70.

The post members 60 are assembled pairwise so that their post member third walls 70 are parallel to each other and spaced apart by their respective post member first and second walls 66 and 68. In this case, the post members 60 form a post 14 having a substantially square cross-section. The post members 60 are interconnected through the use of post member attachments 74. The post member attachments 74 include a post member attachment body 76 and hooks 78 extending therefrom. The hooks 78 extend from a substantially planar post member attachment body 76 and are substantially perpendicular thereto.

The hooks 78 include hooks first portions 80 and hooks second portion 82. The hooks first portions 80 extend substantially perpendicularly to the post member attachment body 76. The hooks second portions 82 are substantially perpendicular to the hooks first portions 80 and are therefore parallel to and spaced apart from the post member attachment body 76.

The posts 14 define a post outer surface 84 and a post passageway 86 extending substantially longitudinally therethrough. The attachment apertures 72 extend between the post outer surface 84 and the post passageway 86 and allow the insertion of the hooks 78 therethrough.

When the hooks 78 are inserted into the attachment apertures 72, the hooks first portion 80 extends through the attachment apertures 72 and the hook second portion 82 is positioned into the post passageway 86.

Also, many of the components of the kit are secured to each other using fasteners. Any suitable fasteners such as screws, nuts and bolts or any alternative fasteners are usable to assemble the house 10. In components that are attached to each other through hooks 78 engaging attachment apertures 72, fasteners may also be used to solidify, lock or both solidify and lock the components to each other.

Furthermore, some of the attachments and brackets usable onto the posts 14 are mirror image of each other and are attachable to the posts 14 so that they are in a mirror image relationship relatively to each other. Then, adjacent attachments and brackets may be secured to each other to provide respectively relatively rigid attachment and bracket assemblies.

The attachment apertures 72 are substantially elongated and extend substantially longitudinally. The attachment apertures 72 are dimensioned to allow inserting the hook second portion 82 therethrough. The hooks 78 allow to releasably attach the post member attachment 74 to the post members 60. The structure of hooks 78 attaching a component to the post member 60 and, therefore, to the post 14, is used in many other attachments in the kit. Therefore, the use the hooks 78 allow to releasably attach any component to the posts 14.

Figure 2A:
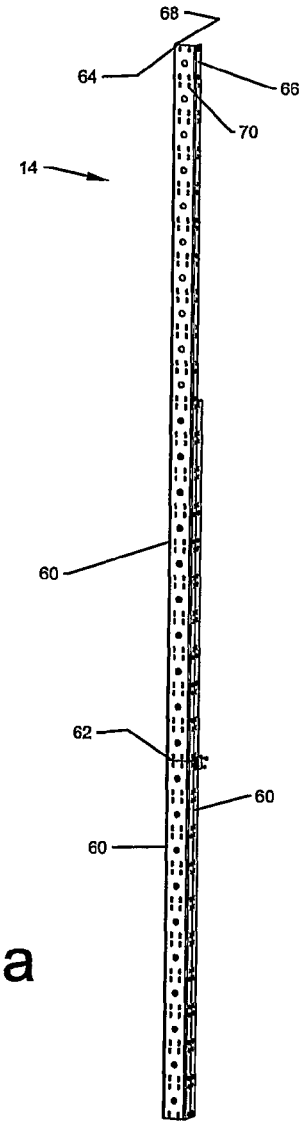
FIG. 2*a*, in a perspective view exploded view, illustrates a post of a kit for assembling the house of FIG. 1.
Figure 2B:
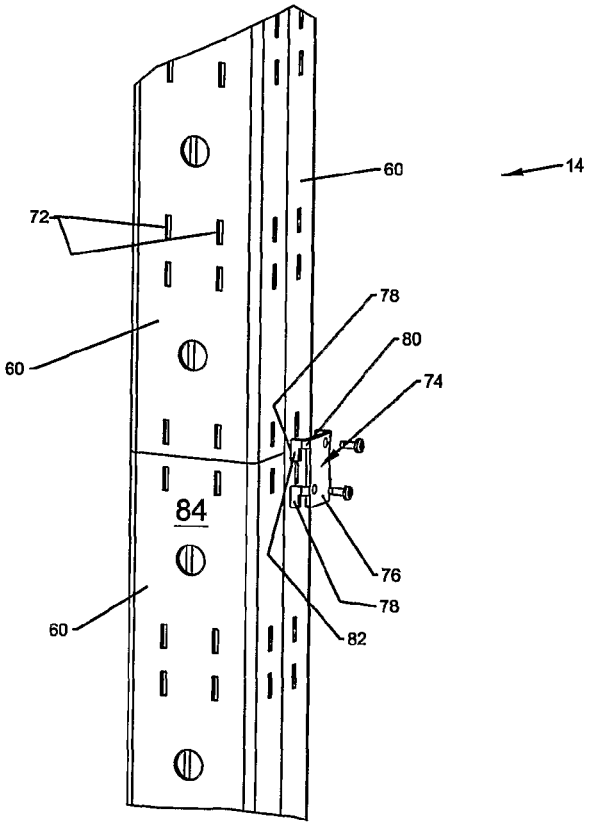
FIG. 2*b*, in a perspective exploded view, illustrates the assembly of post members of the post of FIG. 2*a;*
Figure 2C:
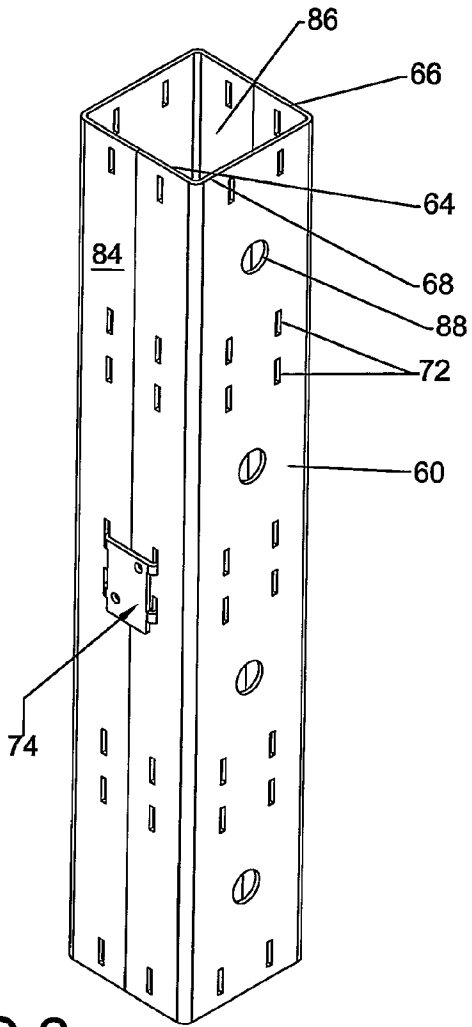
FIG. 2*c*, in a perspective view, illustrates an alternative manner of assembling post members of the post of FIG. 2*b;*
Figure 2D:
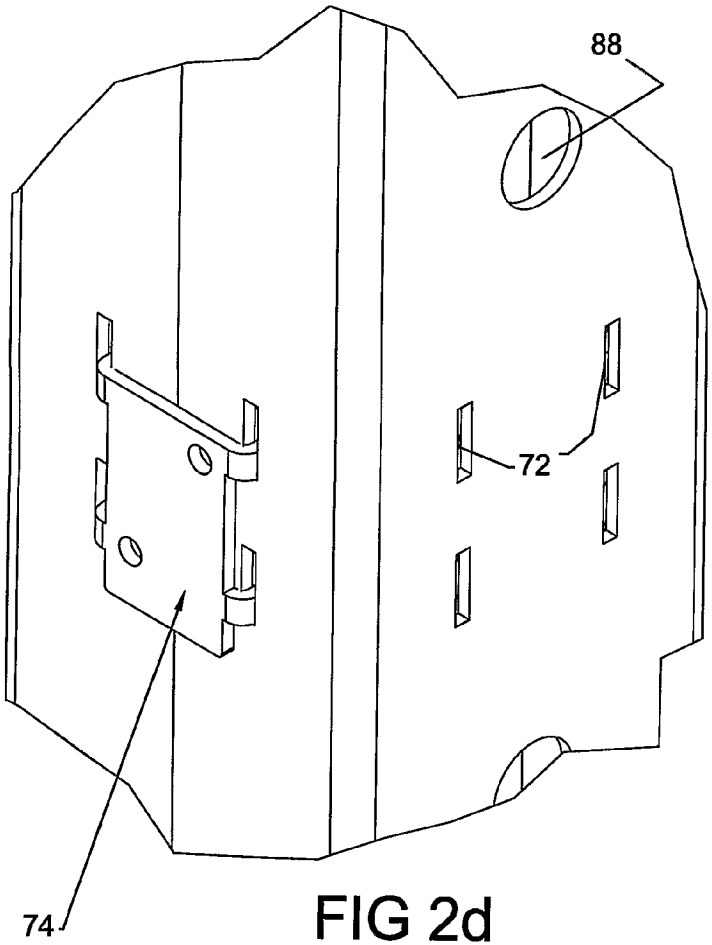
FIG. 2*d*, in a perspective view, illustrates a detail of the attachment of a post attachment bracket to the post members of FIG. 2*c;*

Posts having any suitable longitudinal extension may be assembled using post members 60 as follows. As seen in FIG. 2B, a post member 60 is substantially in register with two other facing post members 60. In other words, the post members 60 overlap each other in a longitudinal direction while being positioned substantially adjacent to each other. The post member attachment 74 attaches to the three post members 60, which allows to build posts 14 having any suitable length and that are relatively rigid.

The posts 14 that are located at the periphery of the house 10 define a post internal surface 90 directed inwardly towards the interior of the house 10, an opposed post external surface 92 directed towards the outside of the house 10 and post intermediate surfaces 94 extending therebetween. The attachment apertures 72 are distributed at substantially similar longitudinal positions over the post internal, external and intermediate surfaces 90, 92 and 94.

As shown in the drawings, in some embodiments of the invention, the attachment apertures 72 are grouped into groups of four attachment apertures 72, the four attachment apertures 72 being longitudinally spaced apart from other groups of attachment apertures found onto the same post internal, external or intermediate surface 90, 92 and 94. Some of the brackets and attachments that are used to attach different components to the posts 14 engage two attachment apertures 72 of the same group. These two attachments may be substantially circumferentially spaced apart or substantially longitudinally spaced apart. Other brackets and attachments engage four attachment apertures 72 of the same group. Yet, other brackets and attachments engage attachment apertures 72 of two longitudinally spaced apart groups.

Figures 6A, 6B, 6C:
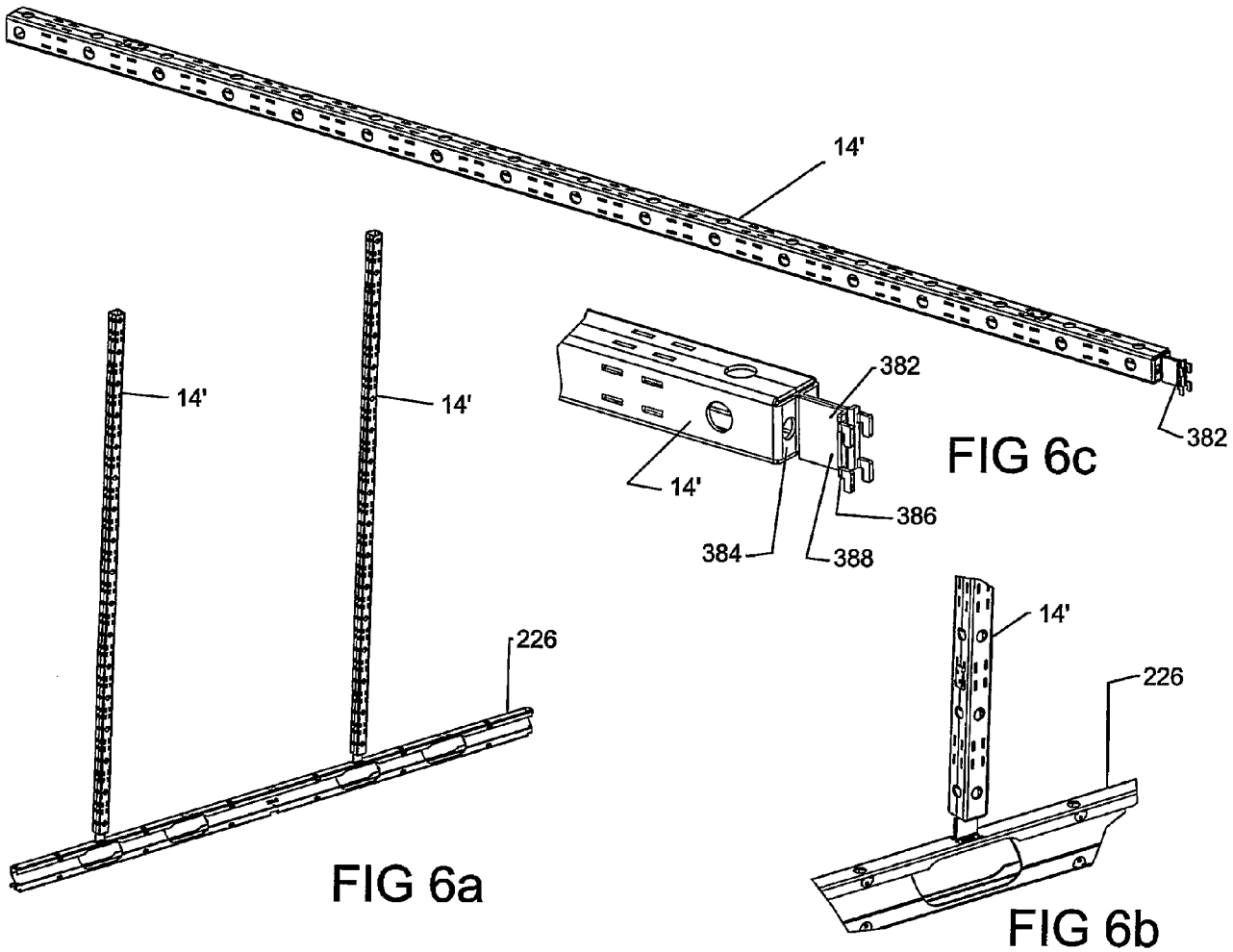
FIG. 6*a*, in a perspective view, illustrates internal posts of the house of FIG. 1 usable for assembling internal divisions into the house.
FIG. 6*b*, in a perspective view, illustrates the attachment of the house internal posts of FIG. 6*a* to floor supports.
FIG. 6*c*, in a partial perspective view, illustrates an internal post supported by an internal post supporting bracket.

Internal divisions into the house 10 are supported by internal posts 14' that are similar to the posts 14, as seen in FIG. 6*a* and as described in further details hereinbelow.

In some embodiments of the invention, post auxiliary apertures 88 are provided into at least one of the post member first, second and third wall 66, 68 and 70. The auxiliary apertures allow to insert through the post 14 components such as electrical wires. Therefore, electrical wires or other wires may be hidden into the post 14 and protected thereby.

While a specific manner of attaching components to the posts 14 is described in this document, the reader skilled in the art will readily appreciate that it is within the scope of the invention to use any other manners of attaching components to the posts 14. For example, and non-limitingly, the posts 14 could include hooks and their different components that are attached to the post 14 could include apertures through which these hooks are inserted.

The hooks 78, when inserted into the attachment apertures 72 suspend different components that include the hooks 78. Therefore, the hooks 78 maintain the different components of the house 10 attached to the posts 14 through the action of gravity.

Figure 4:
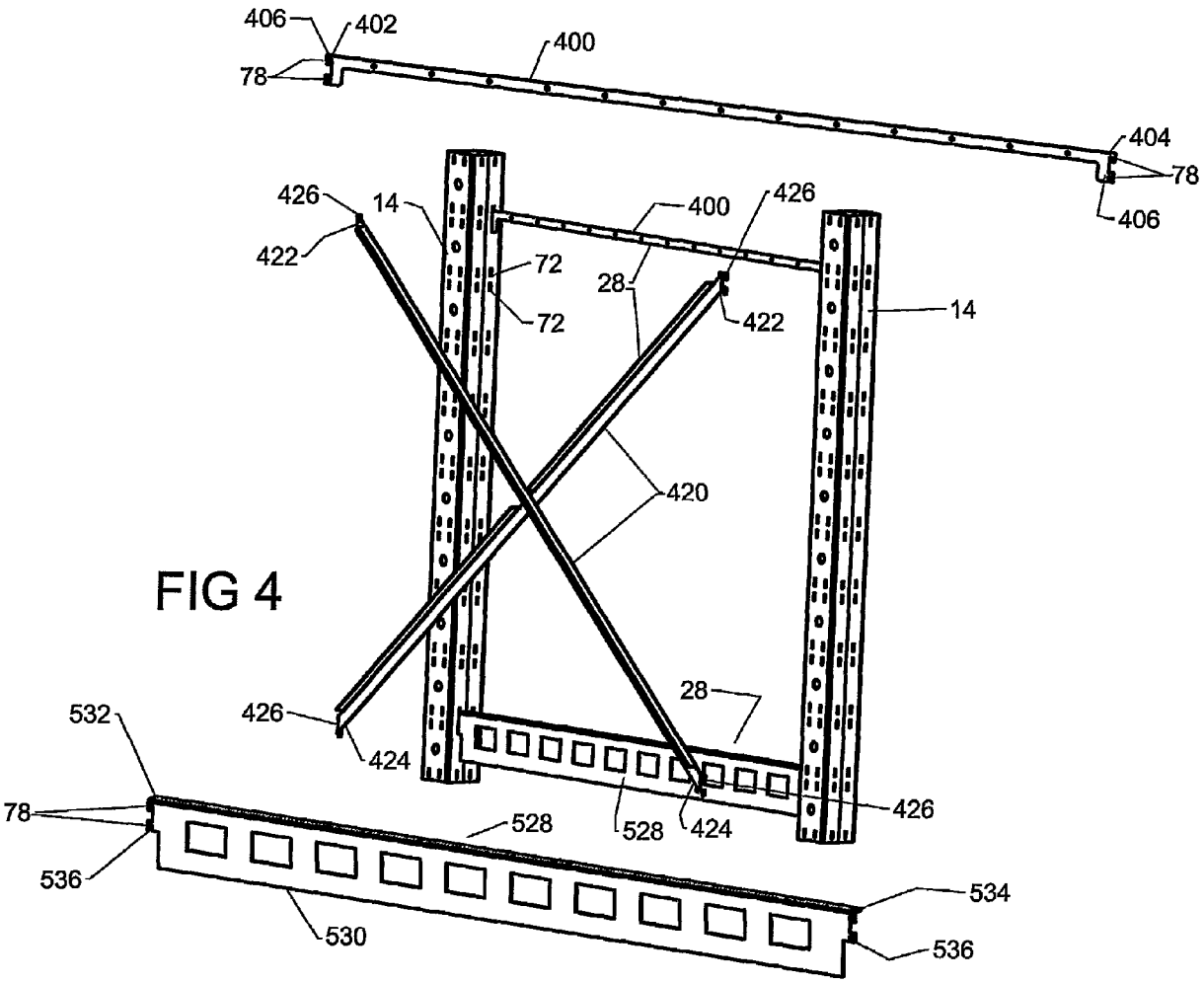
FIG. 4, in a perspective view, illustrates assembling members usable to assemble the house of FIG. 1.
Figure 4A:
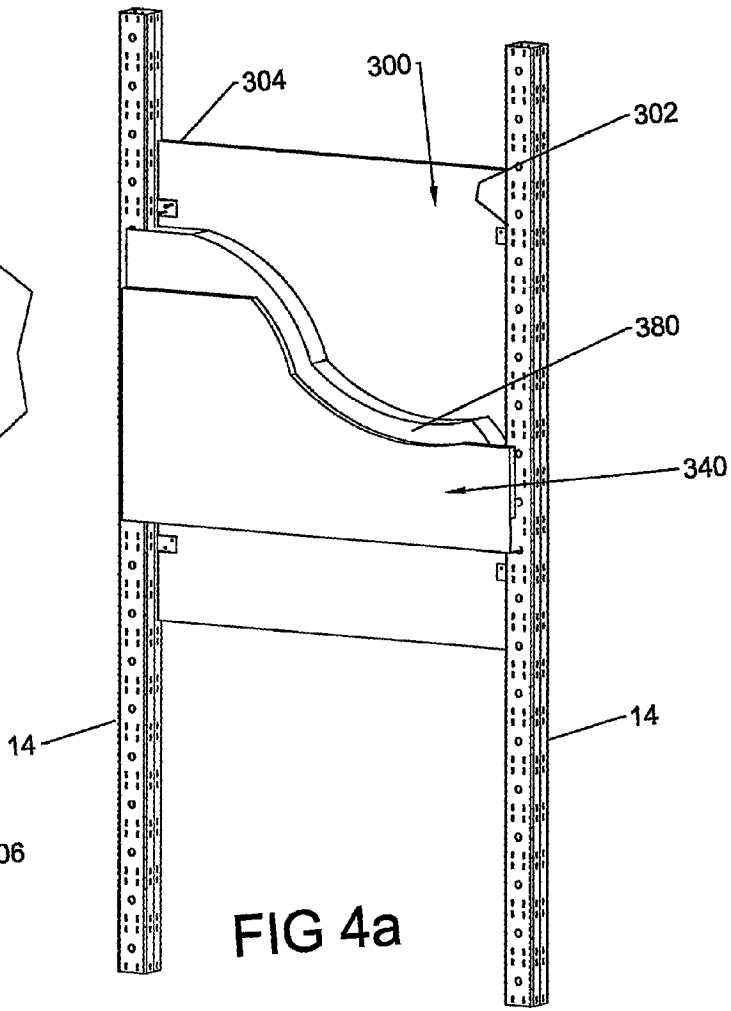
FIG. 4*a*, in a perspective view, illustrates an internal wall panel of the house of FIG. 1 attached to posts of FIG. 2*a;*

Referring to FIG. 4*a*, the walls 20 are attached to the posts 14 as follows. The walls 20 include an internal wall panel 300 that is attached to adjacent posts 14. Furthermore, the walls 20 include an external wall panel 340 that is also attached to adjacent posts 14. The internal and external wall panels 300 and 340 are substantially parallel and in a spaced apart relationship relatively to each other. Also, in some embodiments of the invention, insulation 380 is provided between the internal wall panels 300 and the external wall panels 340.

As seen in FIGS. 3*a* to 3*d*, in some embodiments of the invention, the external wall panels 340 are outwardly spaced apart from the posts 14 and insulation 380 is present between the external wall panels 340 and the posts 14, as seen in FIG. 4*a*. However, in alternative embodiments of the invention, the external wall panels 340 are not spaced apart from the posts 14. Also, in yet other embodiments of the invention, the internal wall panels 300 are not present in the house 10.

Figure 4B:
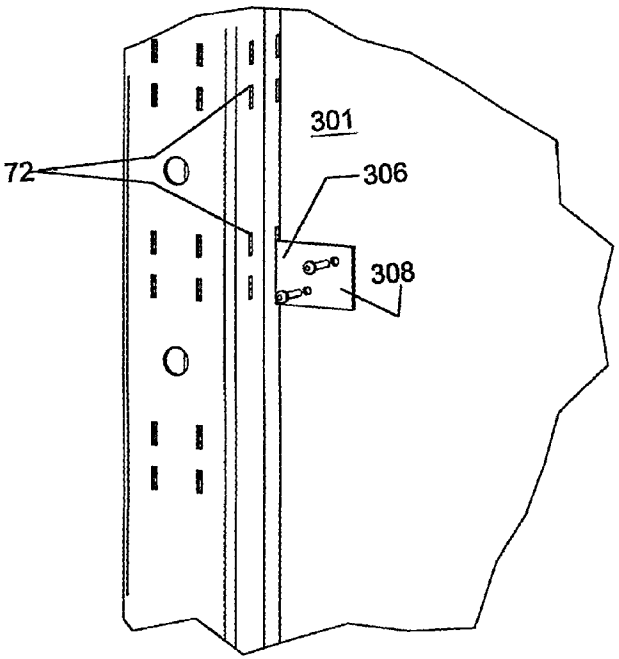
FIG. 4*b*, in a perspective view, illustrates a detail of the attachment of the internal wall panel of FIG. 4*a* to the post of FIG. 2*b;*
Figure 4C:
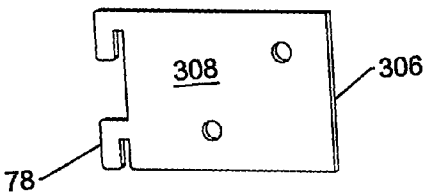
FIG. 4*c*, in a perspective view, illustrates an internal wall panel attachment of the internal wall panel of FIG. 4*a;*

With reference to FIGS. 4*a* to 4*c*, the internal wall panels 300 include a wall panel body 301 defining an internal wall panel first end 302 and a substantially opposed internal wall panel second end 304. The internal wall panel body 301 may be substantially square, substantially rectangular or may have any other suitable shape. The internal wall panel 300 also includes internal wall panel attachments 306 provided substantially adjacent the internal wall panels first and second end 302 and 304. The internal wall panel attachments 306 are distant from each other by a predetermined distance.

The internal wall panel attachments include hooks 78 for releasably attaching the internal wall panel 300 to the posts 14. To this effect, the internal wall panel attachments 306 include an internal wall panel attachment body 308 from which the hooks 78 extend. In some embodiments of the invention, the internal wall panel attachment body 308 is substantially planar and substantially parallel to the internal wall panel 300. For example, the internal wall panel attachment body 308 is secured at the surface of the internal wall panel 300.

In some embodiments of the invention, the internal wall panel body is dimensioned so as to be insertable between two adjacent posts 14. In these embodiments, the internal wall panel attachments 306 have hooks 78 that are inserted into attachment apertures 78 of posts 14 that are provided on post intermediate surfaces 94 of adjacent posts 14 that face each other.

Furthermore, in some embodiments of the invention, the internal wall panel attachments 306 and the internal wall body 301 are configured and sized so that a surface of the internal wall panel body 301 is substantially in register with the post internal surface 90.

Figures 3A, 3B, 3C, 3D:
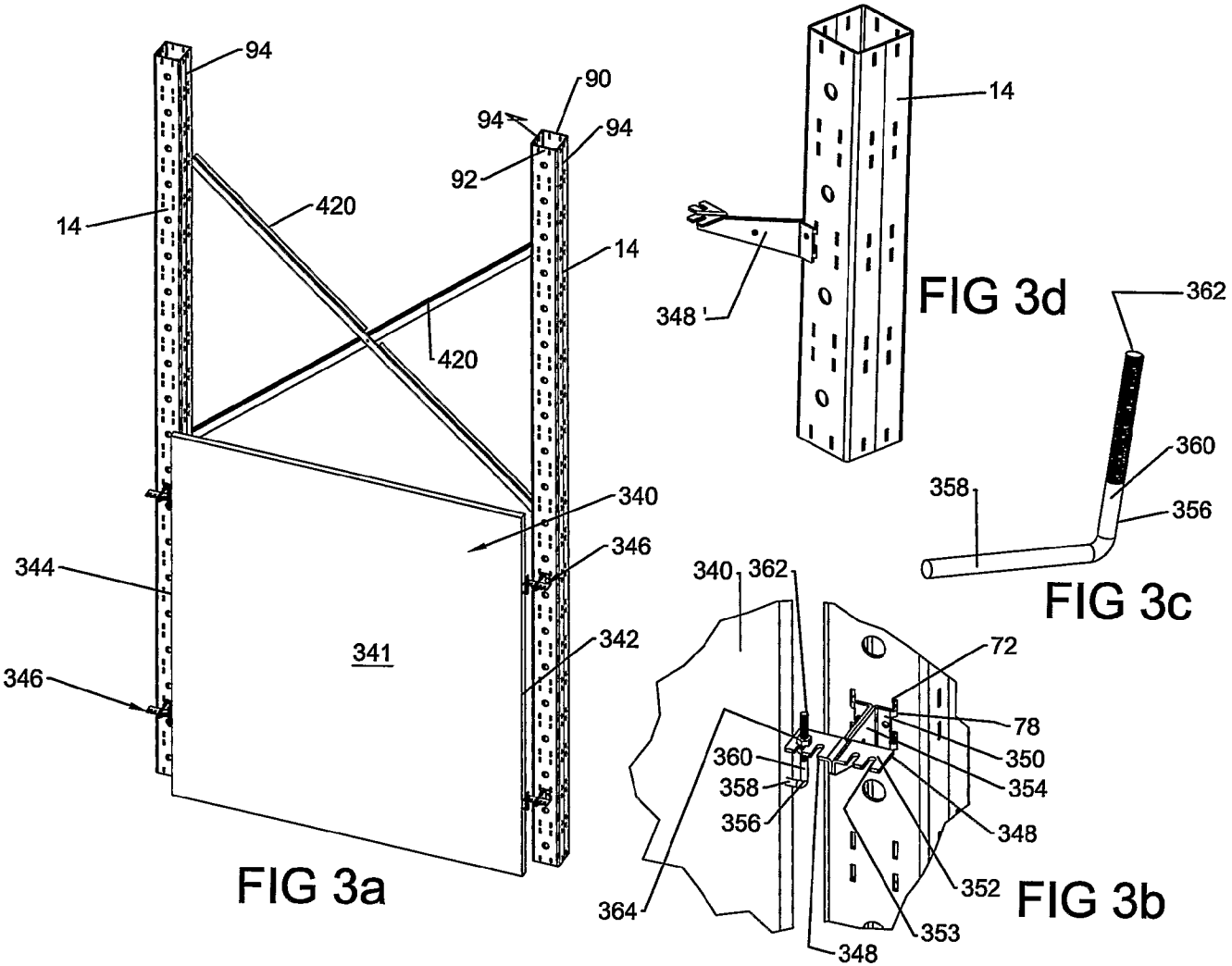
FIG. 3*a*, in a perspective view, illustrates the attachment of an external wall panel of the house 10 to the posts of FIG. 2*a;*
FIG. 3*b*, in a perspective view, illustrates an external wall panel attachment of FIG. 3*a;*
FIG. 3*c*, in a perspective view, illustrates a linking member of the external wall attachment of FIG. 3*b;*
FIG. 3*d*, in a perspective view, illustrates an alternative external wall panel attachment.

As seen in FIGS. 3*a*-3*c*, the external wall panels 340 include an external wall panel body 341. The external wall panel body 341 defines an external wall panel first end 342 and a substantially opposed external wall panel second end 344. The external wall panel body 341 may be substantially square, substantially rectangular or may have any other suitable shape. External wall panel attachments 346 are provided substantially adjacent the external wall panel first and second ends 342 and 344. The external wall panel attachments 346 allow to attach the external wall panels 340 to the posts 14.

The external wall panel attachments 346 include an external wall panel attachment bracket 348 and an external wall panel attachment linking member 356. In some embodiments of the invention, two external wall panel attachment linking members 356 are provided for each external wall panel attachment bracket 348. However, in alternative embodiments of the invention, any suitable number of external wall panel attachment linking members 356 are provided. Also, while the external wall panel attachment 346 described hereinbelow is advantageous in some embodiments of the invention, in other embodiments of the invention, any suitable alternative external wall panel attachment 346 is usable.

The external wall panel attachment bracket 348 includes an attachment bracket post attachment portion 350, an attachment bracket linking member receiving portion 352 and an attachment bracket spacing portion 354 extending therebetween. The attachment bracket spacing portion 354 spaces the attachment bracket post attachment portion 350 apart from the attachment bracket linking member receiving portion 352.

The attachment bracket post attachment portion 350 is provided for attaching the external wall panel attachment bracket 348 to the post 14. To this effect, the attachment bracket post attachment portion 350 includes at least one hook 78 receivable into one of the attachment apertures 72. In some embodiments of the invention, the attachment bracket post attachment portion 350 includes two hooks 78 spaced apart so as to be receivable into two substantially longitudinally adjacent post attachment apertures 72.

In some embodiments of the invention, the attachment bracket post attachment portion 350 includes a substantially flat panel from which the hooks 78 extend substantially perpendicularly. The attachment bracket spacing portion 354 extends substantially perpendicularly from the attachment bracket post attachment portion 350. Furthermore, the attachment bracket linking member is substantially planar and also extends substantially perpendicularly from the attachment bracket spacing portion 354. In some embodiments of the invention, the attachment bracket linking member receiving portion 352 is also substantially perpendicular to the hooks 78.

In other words, in embodiments of the invention wherein one of the posts 14 is installed substantially vertically, the hooks 78 engage in a substantially vertical direction the attachment apertures 72 of the post 14. In this case, the attachment bracket linking member receiving portion 352 is substantially horizontal.

The attachment bracket linking member receiving portion 352 includes attachment bracket grooves 353 extending thereinto substantially towards the attachment bracket post attachment portion 350. With reference to the example given hereinabove, attachment bracket grooves 353 extend substantially perpendicularly to the longitudinal axis of the posts 14.

The external wall panel attachment linking member 356 is substantially L-shaped and includes the linking member first segment 358 and linking member second segment 360. For example, the linking members first and second segments 358 and 360 are substantially cylindrical. The linking member first segment 358 is substantially perpendicular to the linking member second segment 360.

When the external panel attachment linking member 356 is secured to the external wall panel body 341, the linking member first segment extends from the external wall panel body 341 substantially adjacent the external wall panel first end 342. For example, the linking member first segment 358 is inserted into a bore extending into the external wall panel body in direction substantially parallel to the direction extending between the external wall panel first and second ends 342 and 344. When the external wall panel 340 is attached to one of the posts 14, the linking member second segment 360 is parallel to the longitudinal axis of the post 14.

The linking member second segment 360 is inserted into one of the attachment bracket grooves 353. The external wall panel attachment linking member 356 is movable relative to the external wall panel attachment bracket 348. Therefore, the external wall panel attachment linking member 356 allows to move an external wall panel relatively to the post 14. To this effect, threads 362 are provided onto the linking member second segment 360. Two nuts 364 are threaded and unthreaded onto the threads 362 so that the attachment bracket linking member receiving portion 352 is pinched by the nuts 364. Moving the position of the nuts 364 onto the threads 362 allows to adjust the position of the linking member second segment 360 and therefore to move the external wall panel attachment linking member 356 relatively to the external wall panel attachment bracket 348.

Therefore, even through the insertion the external wall panel attachment bracket 348 into the attachment apertures 78 allows to position the external panel attachment bracket 340 only at discreet locations onto the post 14, the use of the external wall panel attachment linking member 360 allows to finely tune the position of the external wall panels 340 relatively to the post 14.

In some embodiments of the invention, two external wall panel attachment linking members 356 are secured to each external wall panel attachment bracket 348. In these embodiments, the linking members second segments 360 are inserted into two different attachment bracket grooves 353.

Furthermore, in some embodiments of the invention, two external wall panel attachment brackets 348 are configured and sized so that they are positionable side by side onto a same face of the posts 14. In these embodiments, the two external wall panel attachment brackets 348 may be secured to each other, for example, through the use of a nut and a bolt, so as to form a relatively solid assembly allowing to attach two external wall panels 340 to a same post 14. Therefore, these external wall panels 340 attached to the same post 14 are positioned side by side.

In some embodiments of the invention, adjacent internal wall panels 300 or external wall panels 340 are positioned substantially perpendicular to each other. In other words, the internal and external walls 300 and 340 are located at corners of the house 10. In these embodiments, as seen for example in FIG. 3*d*, alternative brackets and attachments, such as for example the alternative external wall panel attachment bracket 348', extend in a direction substantially oblique relatively to the surfaces of the post 14. These brackets are configured so that the external and internal wall panels 340 and 300 are attachable to the brackets in a manner similar to the way into which the internal and external wall panels 300 and 340 are attached to each other when the wall panels are parallel to each other. In other words, the alternative brackets are configured so that the same wall panels 300 and 340 are usable both adjacent corners of the house 10 and at other locations of the house 10.

External finishing panels 366, seen on FIG. 1, and internal finishing panels (not seen in the drawings) are disposed so that they overlap a post 14 and respectively external wall panels 340 and the internal wall panels 300. Therefore, the external finishing panels 366 and the internal finishing panels allow to cover the posts 14 so that they are hidden from view.

Referring to FIG. 5*a*, the foundation 12 includes a footing 500 and foundation walls 502 that extend substantially upwardly from the footing 500. The footing 500 is substantially plate-shaped and defines a ridge 501 extending substantially upwardly substantially adjacent the periphery thereof. The posts 14 are supported onto the ridge 501 as described in further details hereinbelow.

The foundation walls 502 are substantially adjacent the ridge 501 and are positioned outwardly relatively to the posts 14. For example, the foundation walls 502 and the footing 500 are made of concrete. However, it is within the scope of the invention to use any other suitable material to build the footing 500 and the foundation wall 502.

In some embodiments of the invention, the foundation walls 502 are reinforced through the use of reinforcement 506. The reinforcement 506 includes reinforcement rods 508 that are disposed substantially horizontally and outwardly with respect to the posts 14. To this effect, reinforcement supporting brackets 510 are attached to the posts 14 so that they face outwardly relatively to the house 10.

Figure 5C:
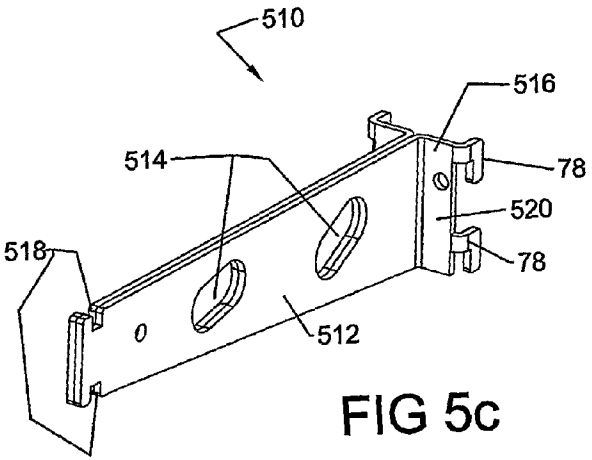
FIG. 5*c*, in a perspective view, illustrates a reinforcement supporting bracket of the foundation of FIG. 5*a;*

The reinforcement supporting brackets 510, seen in FIG. 5*c* include a reinforcement supporting bracket body 512 that may, for example, be substantially planar. Reinforcement rods receiving apertures 514 are formed into the reinforcement supporting bracket body 512. The reinforcement rods receiving apertures 514 receive the reinforcement rods 508 therethrough. For example, the reinforcement rods receiving apertures 514 and the reinforcement rod 508 are substantially tight-fitting.

The reinforcement supporting bracket 510 includes also a reinforcement supporting bracket attachment portion 516 for attaching the reinforcement supporting bracket 510 to the posts 14. The reinforcement supporting bracket attachment portion may, for example, include a plate 520 that extends substantially perpendicularly to the reinforcement supporting bracket body 512. Hooks 78 also extend from the plate 520 so that the reinforcement supporting bracket 510 is attachable to the posts 14 so that the reinforcement supporting bracket body 512 extends substantially perpendicularly and outwardly from the post 14. Notches 518 are formed into the reinforcement supporting bracket 512 distally from the reinforcement supporting bracket attachment portion 516. The notches 518 extend into the reinforcement supporting bracket body 512 substantially vertically when the reinforcement supporting bracket 510 is attached to the post 14. The notches 518 are usable to lock a framing 522 to the reinforcement 506.

Figure 5B:
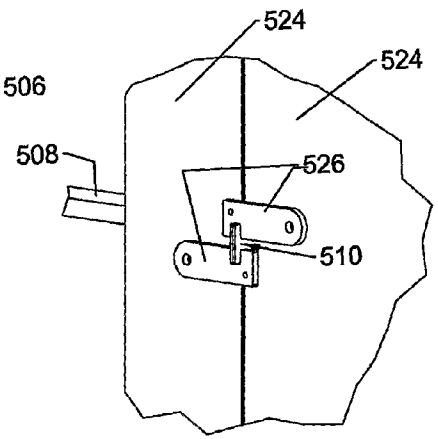
FIG. 5*b*, in a perspective view, illustrates the attachment of framing panels usable to pour the foundation of FIG. 5*a;*
Figure 5A:
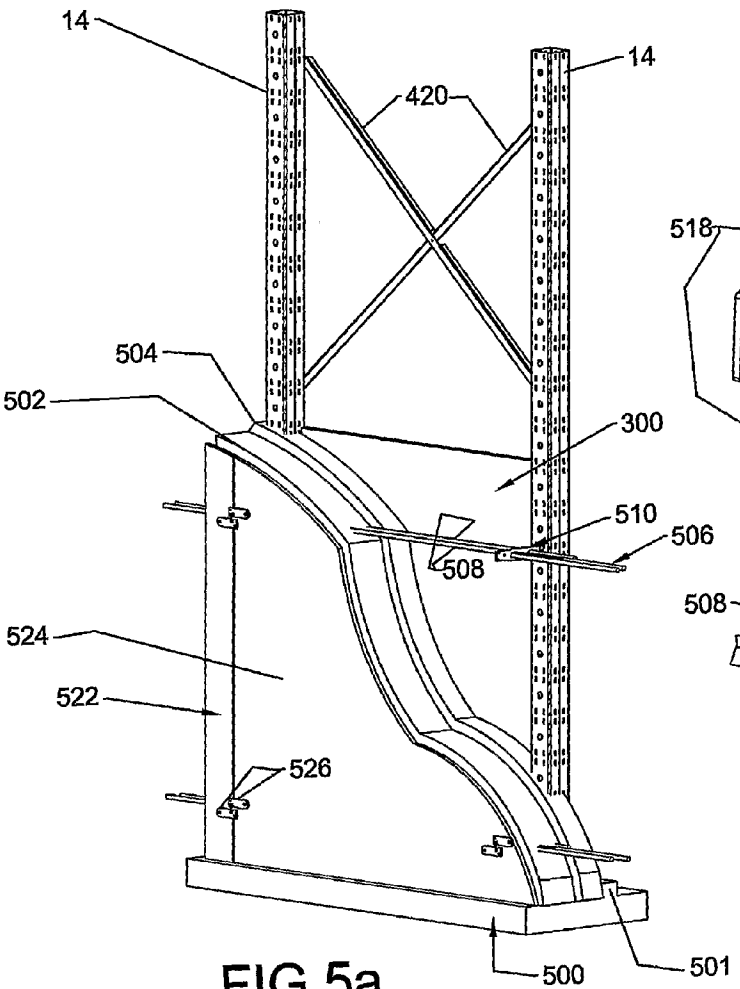
FIG. 5*a*, in a partial perspective view, illustrates a foundation of the house of FIG. 1.

Prior to pouring the foundation wall 502, framing 522 is secured to the reinforcement supporting brackets 510. The framing 522 includes framing panels 524 and a framing lock 526 to lock the framing panels 524 to the reinforcement supporting bracket 510. The framing locks 526, better seen in FIG. 5*b*, engage the notches 518 so as to prevent outward movement of the framing panels 524 when the framing panels 514 abut substantially laterally the reinforcement supporting brackets 510. The framing panels 524 are supported substantially perpendicular to the reinforcement supporting bracket body 512. The framing locks 526 releasably attach the framing panels 524 to the reinforcement supporting bracket 510. Any suitable number of reinforcement rods 508 are usable to reinforce the foundation wall 502.

In some embodiments of the invention, bracing 528, seen in FIG. 4, is secured to the post 14 prior to pouring the foundation wall 502. The bracing 528 is releasably attachable to the posts 14 and serves to reinforce the posts 14 so that posts 14 stay relatively fixed with respect to the footing 500 when the foundation wall 502 is poured and the foundation wall 502 cures.

The bracing 528 includes a substantially elongated bracing beam 530 defining a bracing beam first end 532 and a bracing beam second end 534. Bracing beam attachments 536 are located substantially adjacent the bracing beam first and second ends 532 and 534. The bracing beam attachments 536 attach the bracing beams 530 to the posts 14 and include hooks 78. The bracing 528 is attachable to the posts 14 so as to be substantially perpendicular thereto.

The posts 14 are secured to the foundation 12 at substantially equal distances from each other. To this effect, a template 538, seen in FIGS. 15*a*-15*c*, is usable to drill holes 539 into the footing 500 so that posts supporting brackets 544 may be secured to the footing 500. Then, securing the posts 14 to the post supporting bracket 544 allows to position the posts 14 at substantially equally spaced intervals relative to each other.

Figures 7A, 7B, 7C:
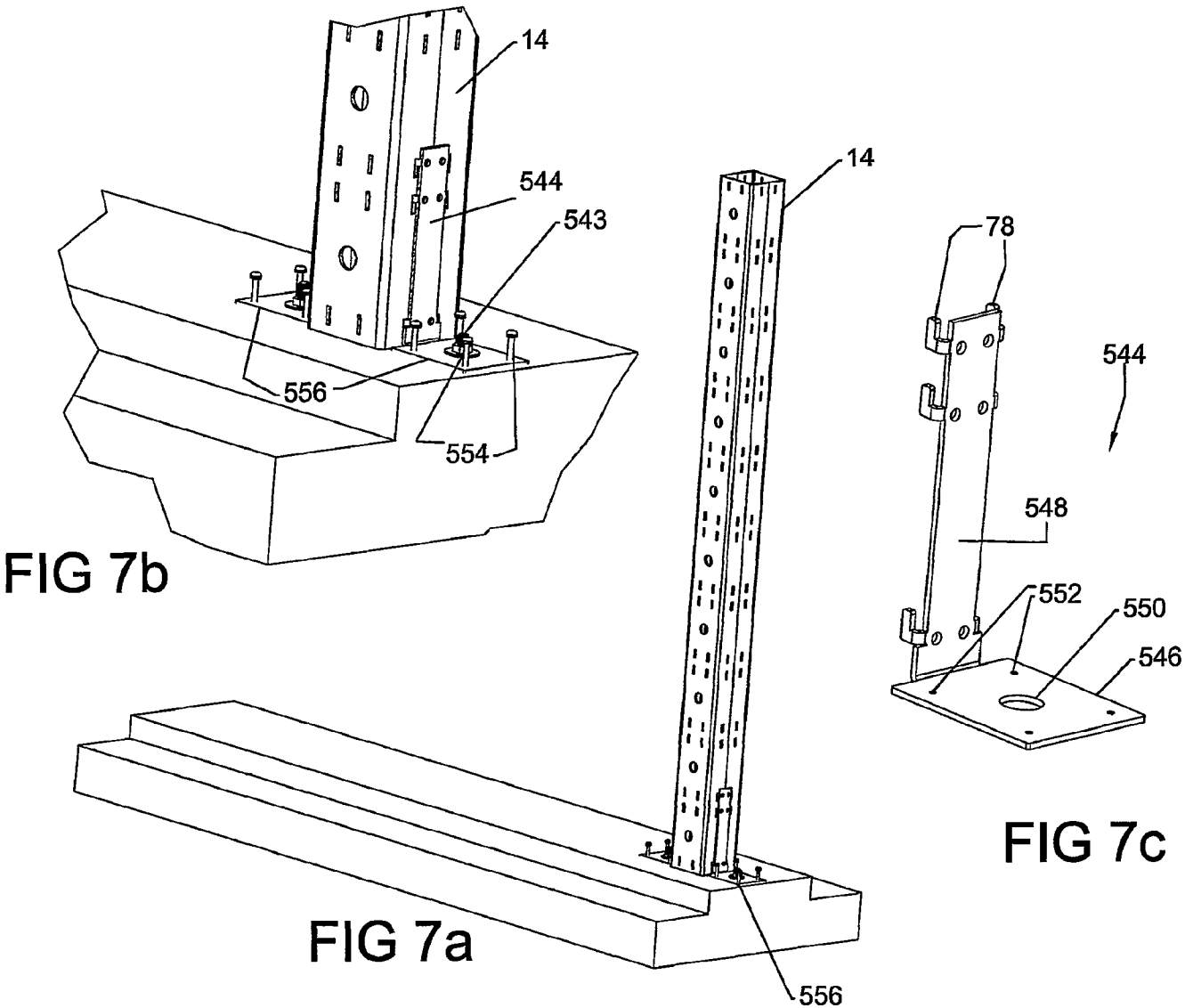
FIG. 7*a*, in a perspective view, illustrates a post of FIG. 2*a* attached to the foundation of FIG. 5*a;*
FIG. 7*b*, in a perspective view, illustrates the attachment of the post of FIG. 2*b* to the foundation of FIG. 5*a;*
FIG. 7*c*, in a perspective view, illustrates a post supporting bracket for attaching the post of FIG. 2*b* to the foundation of FIG. 5*a;*

To this effect, the template 538 includes the template 538 includes template rod apertures 542 for drilling holes wherein rods 543, seen in FIG. 7*b*, are insertable into the footing 500 to secure the posts supporting bracket 544 thereto. Template 538 is typically used only to drill holes into the footing 500 and is removed from the footing 500 prior to attaching the posts 14 to the footing 500.

Referring to FIGS. 7*a*-7*c*, the posts 14 supporting brackets 544 include a post supporting bracket first plate 546 and a post supporting bracket second plate 548 that extends substantially perpendicularly thereto at the periphery thereof. Therefore, the posts supporting brackets 544 are substantially L-shaped. The post supporting bracket first plate includes post supporting bracket rod apertures 550 for receiving the rods 543. Furthermore, the posts supporting bracket first plate 546 includes post supporting bracket fastener apertures 552 to receive fasteners, such as screws 554, therethrough.

When positioned onto the footing 500, the post supporting bracket first plate 546 is substantially parallel to the footing 500. To ensure that the posts 14 are substantially vertical, the post supporting bracket first plate 546 may be leveled by inserting the post supporting screws 554 more or less deeply into the footing 500. Then, grout 556 may be used to support the post supporting bracket first plate 546 at a substantially level attitude. The post supporting bracket second plate 548 includes hooks 78 extending substantially perpendicularly therefrom to engage attachment apertures 72.

While a specific manner of attaching the posts 14 to the footing 500 has been described hereinabove, the reader skilled in the art can readily appreciate that the posts 14 may be secured to the footing 500 in any other suitable manner.

Referring to FIG. 8*a*-8*d*, the floor 18 includes main beams 200 and auxiliary beams 212 that are substantially perpendicular to the main beam 200. The main beams 200 are supported by the posts 14. The auxiliary beams 212 are supported by the main beams 200 and by the posts 14. The auxiliary beams 212 are substantially parallel to each other and spaced apart by substantially the predetermined distance between adjacent posts 14. Floor supports 226 are supported by the auxiliary beams 212 substantially perpendicularly to the auxiliary beams 212. Furthermore, the floor support 226 support tiles 236.

Figures 9A, 9B, 9C:
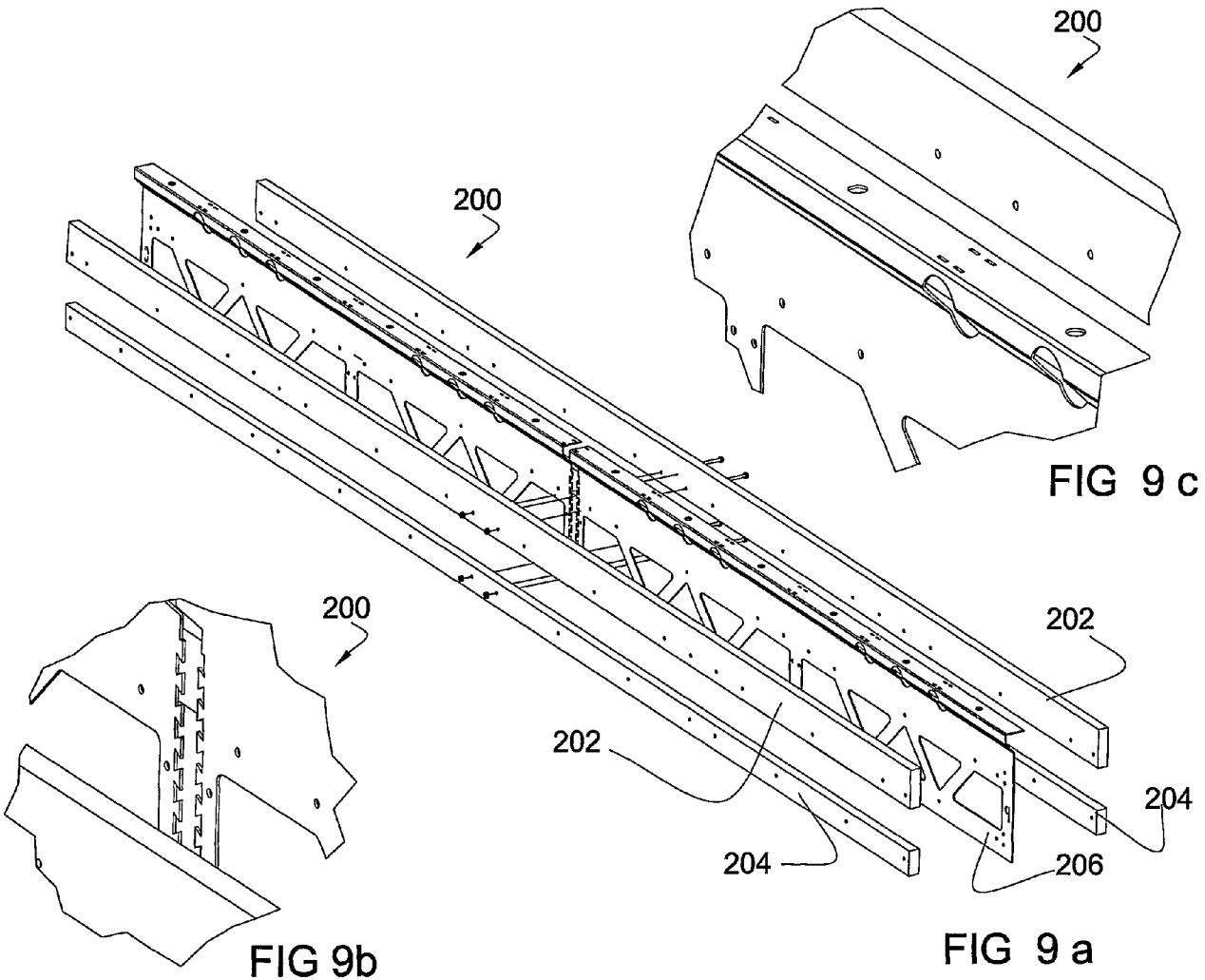
FIG. 9*a*, in a perspective exploded, view, illustrates a main beam of the floor of FIG. 8*a;*
FIG. 9*b*, in a perspective view, illustrates the interlocking of two components of the main beam of FIG. 9*a;*
FIG. 9*c*, in a partial perspective view, illustrates a main beam interconnecting member of the main beam of FIG. 9*a;*

Referring to FIGS. 9*a*-9*c*, the main beams 200 are substantially elongated and include two main beam upper members 202 and substantially opposed main beams second lower members 204. The main beam upper members 202 are substantially elongated and parallel to each other. Similarly, the main beam lower members 204 are also substantially elongated and substantially parallel to each other. A main beam interconnecting member 206 interconnects the main beam upper members 202 to the main beam lower members 204. Typically, the main beam interconnecting member 206 is an open metallic structure and the main beam upper and lower members 202 and 204 are made of wood. In some embodiments of the invention, the main beam interconnecting member 206 may include one or more sections that are securable to each other through substantially trapezoidal protrusions that engage substantially trapezoidal recesses.

The main beam upper members 202 compress part of the main beam interconnecting member 206 therebetween. Similarly, the main beam lower members 204 compress part of the main beam interconnecting member 206 therebetween. To that effect, the main beam upper members 202 are secured to each other using fasteners, and the main beam lower members 202 are secured to each other using fasteners. Any suitable fastener is usable such as, for example, nuts and bolts. The main beam support 210 extends substantially upwardly from the main beam interconnecting member 206. The main beam support 210 is substantially Z-shaped and is usable to the floor supports 226 that are further described hereinbelow.

Figures 10A, 10B:
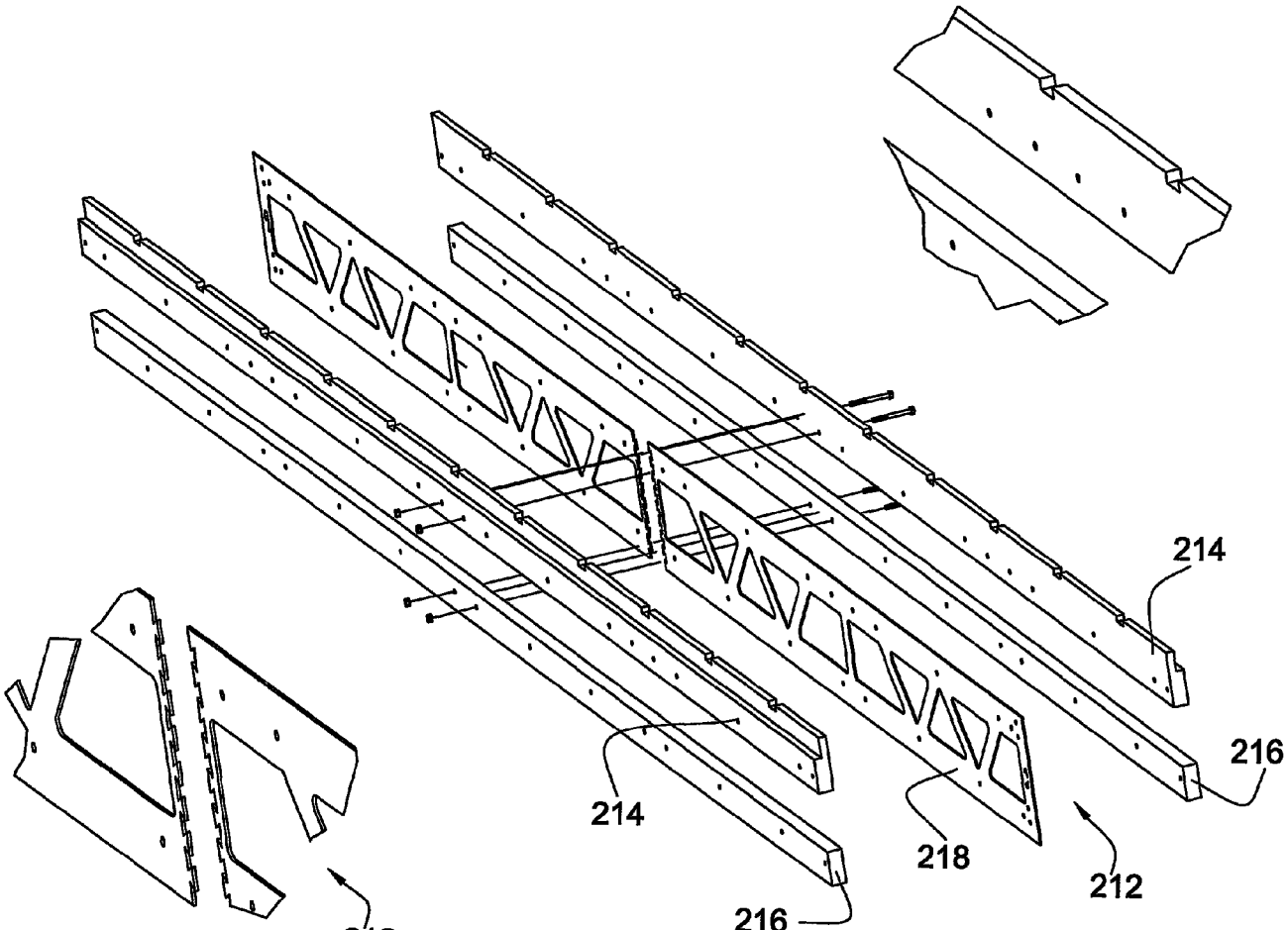
FIG. 10*a*, in a perspective exploded view, illustrates an auxiliary beam of FIG. 8*a;*
FIG. 10*b*, in a perspective view, illustrates the interlocking of two components of the auxiliary beam of FIG. 10*a;*
Figures 11A, 11B, 11C, 11D, 11E:
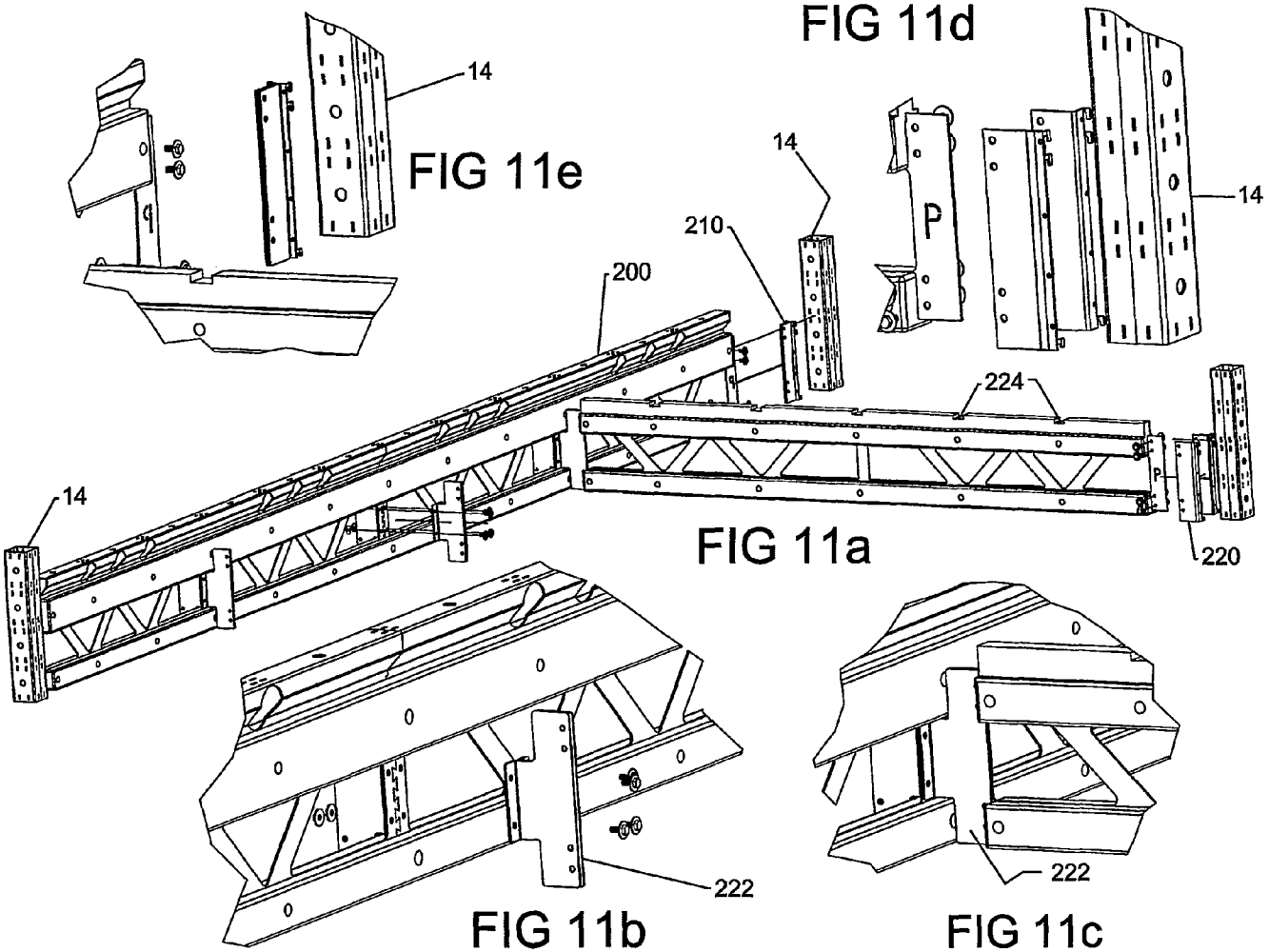
FIG. 11*a*, in a perspective view, illustrates a main beam of FIG. 8*a* attached to two posts and an auxiliary beam of FIG. 8*a* attached to the main beam and to the post.
FIG. 11*b*, in a perspective exploded view, illustrates the attachment of the auxiliary beam of FIG. 11*a* to the main beam of FIG. 11*a;*
FIG. 11*c*, in a perspective view, illustrates the attachment of the auxiliary beam to the main beam.
FIG. 11*d*, in a perspective exploded view, illustrates the attachment of the auxiliary beam of FIG. 11*a* to a post.
FIG. 11*e*, in a perspective exploded view, illustrates the attachment of the main beam of FIG. 11*a* to a post.

Referring to FIGS. 10*a*-10*c*, the auxiliary beams 212 each include two auxiliary beam upper members 214 and two auxiliary beam lower members 216. An auxiliary beam interconnecting members 218 interconnect auxiliary beam upper members 212 to auxiliary beam lower members 218. In this respect, the auxiliary beam 212 is similar to the main beam 200. The auxiliary beams 212 are secured to the main beams 200 through auxiliary beam-to-main beam attachment members 222 that take the form of substantially T-shaped plates from which attachment plates extend substantially perpendicularly. The attachment plates are securable to the main beam interconnecting members 218.

Typically, the auxiliary beam interconnecting member 218 is an open metallic structure and the auxiliary beam upper and lower members 212 and 214 are made of wood.

Similarly, auxiliary beam-to-post attachment members 220 are also pinched by the auxiliary beam upper members 214 and between the auxiliary beam lower members 216, the auxiliary beam-to-post attachment members 220 including hooks 78 for attachment to the post 14. The auxiliary beam upper members 220 define auxiliary beam support receiving recesses 224 that extend substantially downwardly into the auxiliary beam first lateral members 214. The attachment of the main and auxiliary beams 200 and 220 to each other and to the posts 14 is better illustrated in FIGS. 11*a*-11*e*.

Figures 8A, 8B, 8C:
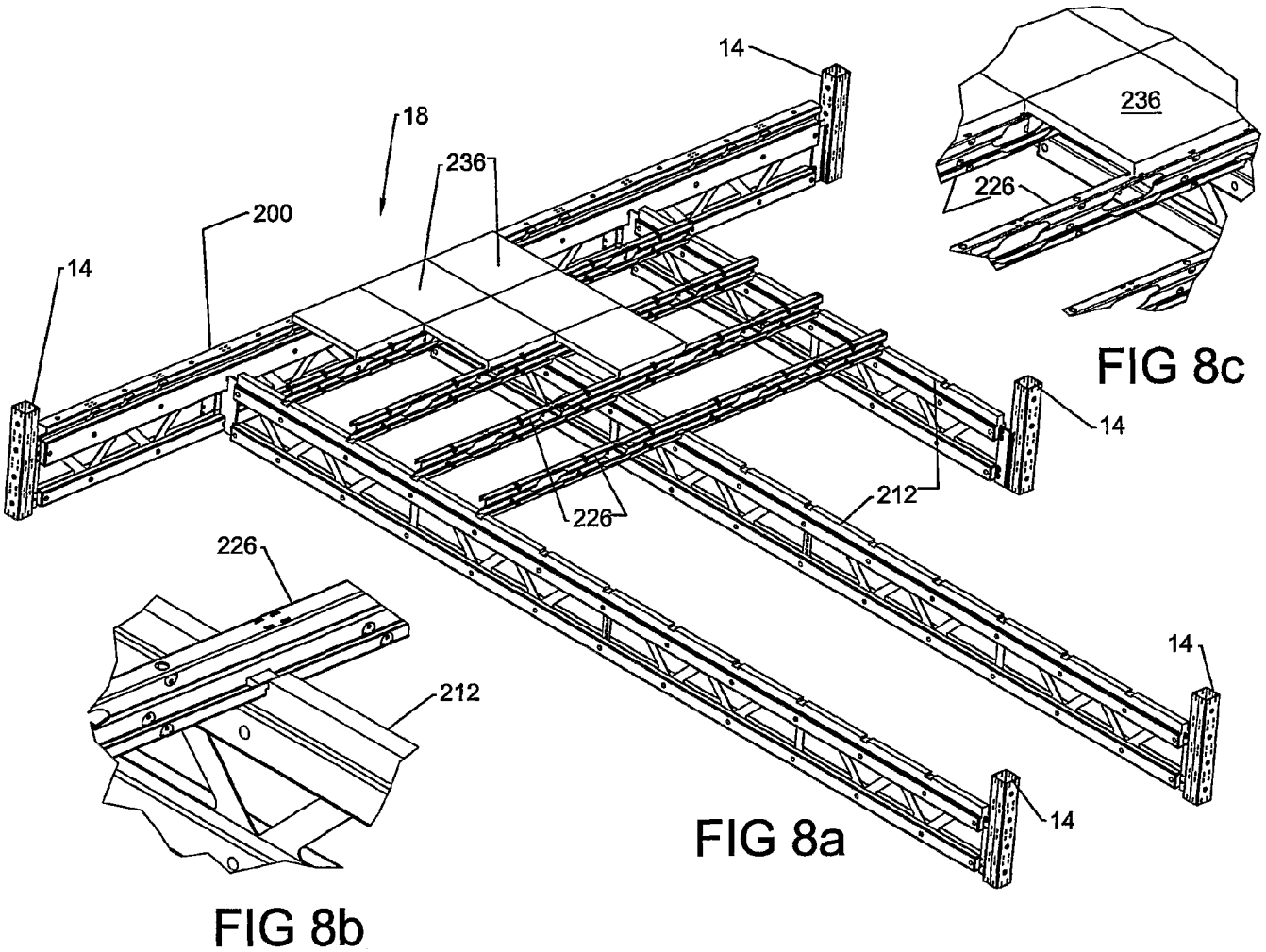
FIG. 8*a*, in a perspective view, illustrates a floor of the house of FIG. 10.
FIG. 8*b*, in a perspective view, illustrates a floor support of the floor of FIG. 8*a* supported by an auxiliary beam of the floor of FIG. 8*a;*
FIG. 8*c*; in a perspective view, illustrates a tile of the floor of FIG. 8*a* supported by two adjacent floor supports of FIG. 8*b;*
Figure 8D:
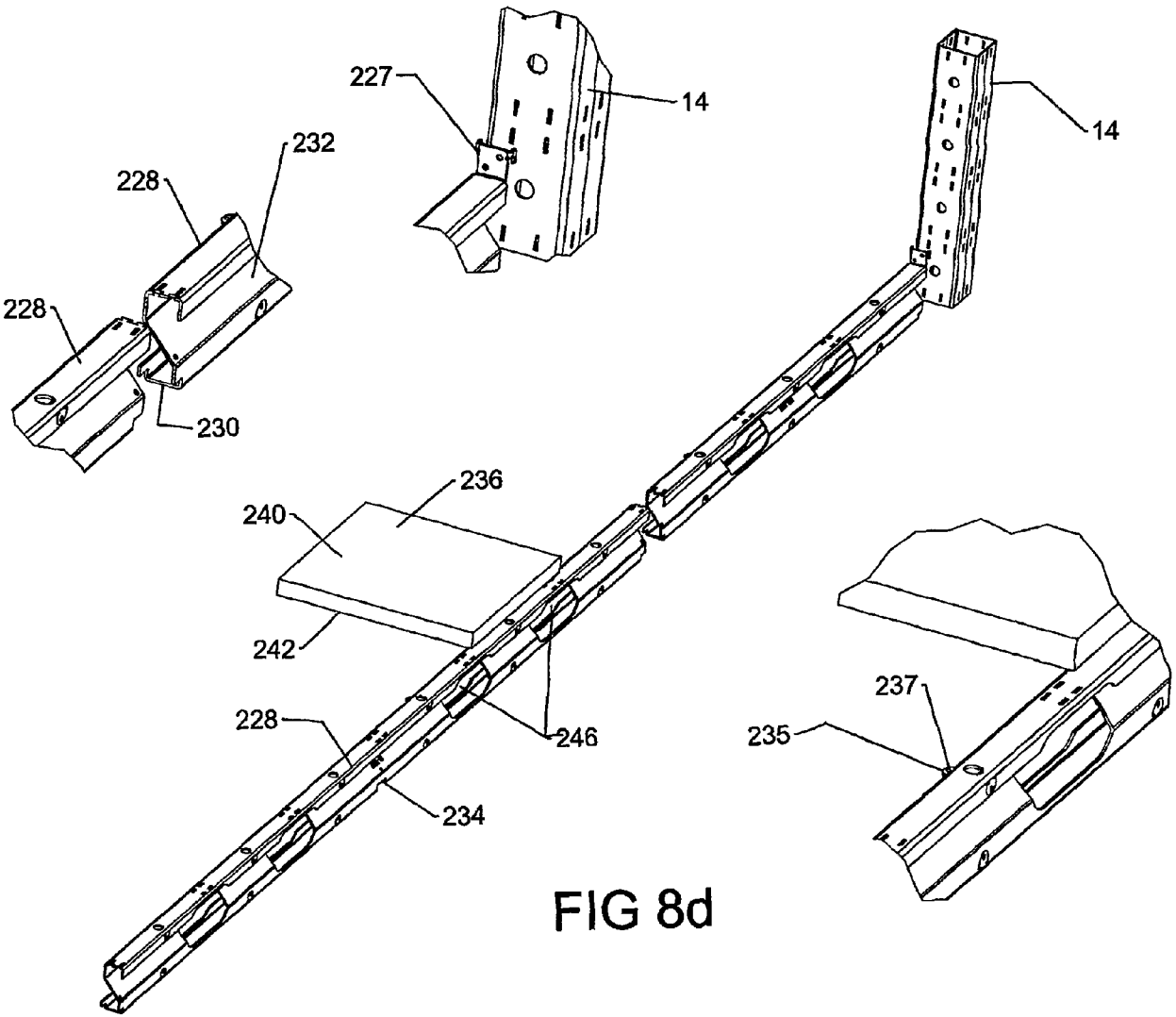
FIG. 8*d*, in an exploded view, illustrates the tiles of FIG. 8*c* supported by the floor support of FIG. 8*b;*

The floor supports 226 are substantially elongated and have a substantially Z-shaped cross-section and, as such, include a floor support first lateral portion 228, a substantially opposed floor support second lateral portion 230 and a floor support spacing portion 232 extending therebetween. The floor support first lateral portion 228 defines floor support recesses 234 that extend substantially inwardly into the floor supports 226. The floor support recesses 234 are positioned so as to be insertable into the auxiliary beam support receiving recesses 224 to interlock the auxiliary beams 212 and the floor support 226. The floor supports 226 are attachable to the posts 14 through a floor support attachment bracket 227, as seen in FIG. 8*d*. Also, the floor supports 226 are reversibly lockable to each other so that they form longitudinally extending floor support assemblies, as seen in FIG. 8*d*.

Floor support apertures 235 are provided for securing the tiles 236 to the floor support 226. In some embodiments of the invention, the floor support apertures are formed into tongues 237. For example, the tongues 237 are formed into floor supports first lateral portion 228 so as to be pivotable relatively thereto from a retracted configuration, when the tongues 237 are substantially parallel to the portion of the floor support first lateral portion from which they extend and in a tongue extended configuration wherein the tongues 237 are positioned so as to be substantially parallel to the tiles 236. Furthermore, in some embodiments of the invention, the floor support spacing portion 232 includes auxiliary apertures 237 for allowing the passage of electrical wires and any other suitable component of the house 10 therethrough.

The tiles 236 each include a tile first surface 240 and a tile second surface 242 substantially opposed to the tile first surface 240. The tiles 236 each includes tile attachment holes 238 extending from the tile first surface 240 towards the tile second surface 242 at locations that are substantially in register with the tongues 237. The tiles 236 are secured to the floor support structure 226 through fasteners that are inserted through the tile attachment holes 238 and through the floor support apertures 235 of the tongues 237. In some embodiments of the invention, the tiles 236 are substantially square and are dimensioned so as to span a distance between adjacent floor supports 226. Therefore, the tiles 236 are supported by adjacent floor supports 226.

In some embodiments of the invention, the tiles 236 directly abut the floor supports 226. In other embodiments of the invention, a resilient strip (not shown in the drawings) made, for example, of rubber or of any other suitable material, is inserted between the tiles 236 and the floor supports 226 so as to improve the acoustics of the house 10.

Figure 13A:
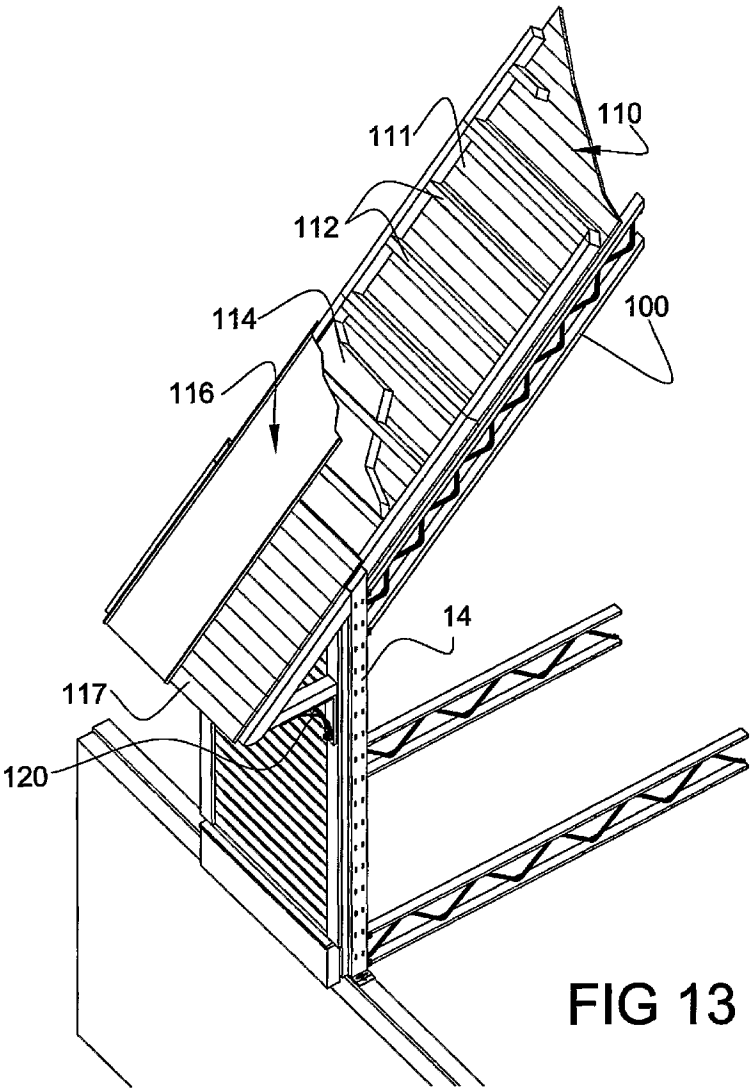
FIG. 13*a*, in a perspective view, illustrates a roof of the house of FIG. 1.
Figure 13B:
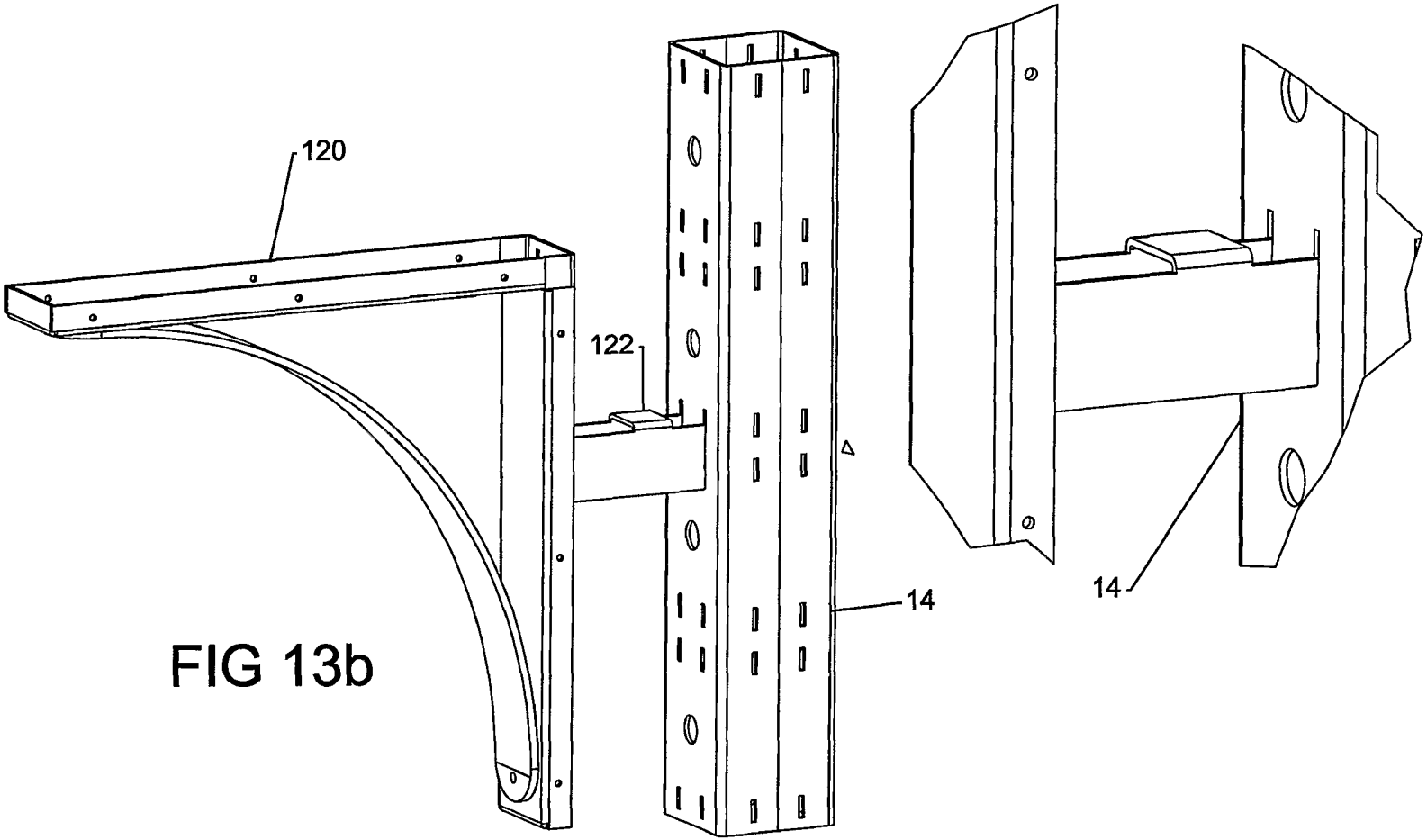
FIG. 13*b*, in a perspective view, illustrates a corbel that partially supports the roof of FIG. 12*a;*
Figure 13C:
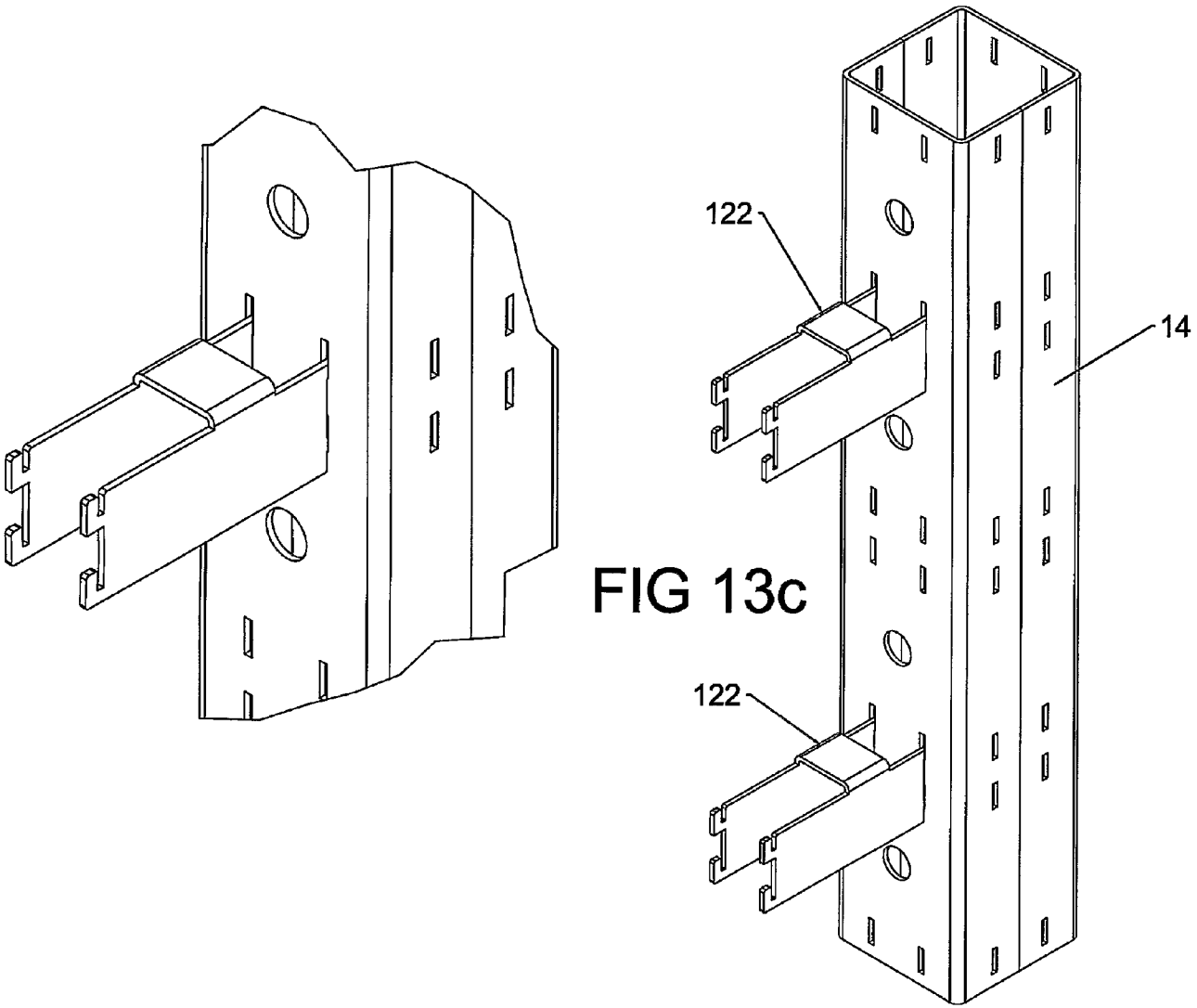
FIG. 13*c*, in a perspective view, illustrates a corbel attachment bracket for supporting the corbel of FIG. 12*b;*
Figures 14A, 14B, 14C, 14D:
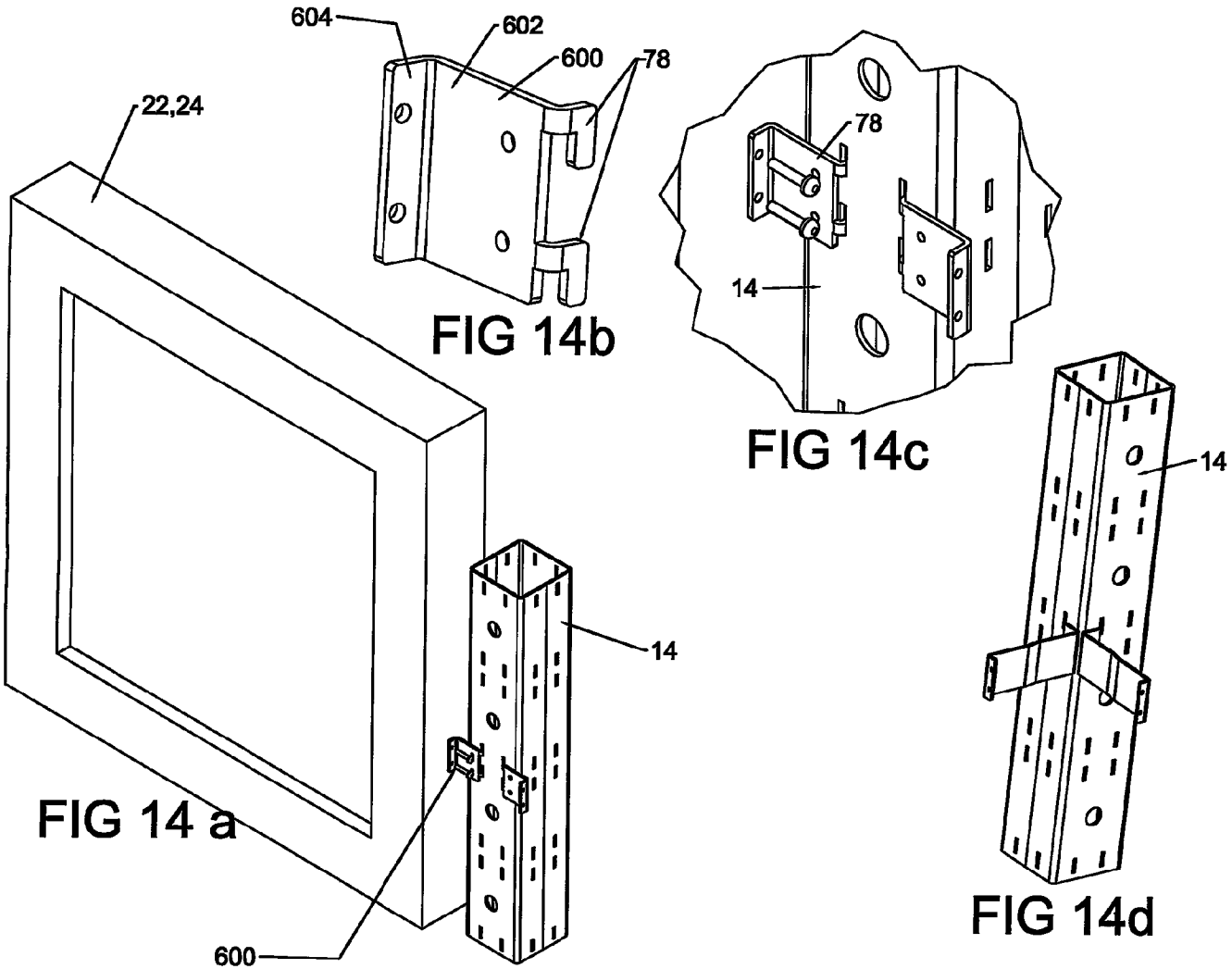
FIG. 14*a*, in a perspective view, illustrates the attachment of a window to the post of FIG. 2*a;*
FIG. 14*b*, in a perspective view, illustrates an attachment bracket for attaching the window of FIG. 14*a* to the post of FIG. 2*b;*
FIG. 14*c*, in a perspective view, illustrates the bracket of FIG. 14*b* attached to a post of FIG. 2*a;*
FIG. 14*d*, in a perspective view, illustrates alternative attachment brackets for attaching windows to the post of FIG. 2*a;*

Referring to FIG. 13*a*, roof beams 100 are secured to the posts 14 through a roof beam attachment (not seen in the drawings). The roof beams 100 are similar to the main beams 200 and are therefore not described in all details herein. Two roof beams 100 are attachable to each other so that they form an acute angle through the use of a roof beam inter-beam attachment. Using roof beam inter-beam attachments of suitable lengths allows to build roofs 16 having various shapes with the roof beams 100 having various angles therebetween. Furthermore, referring to FIGS. 13*a* and 13*b*, the roof 16 is attached to the posts 14 through corbels 120 which are themselves supported by substantially U-shaped corbel attachments 122. Referring to FIG. 13*c*, the corbel attachments 122 may also be attached to the posts 14 to secure any other suitable components of the house 10 thereto, such as for example balconies, patios and flower boxes, among others.

In some embodiments of the invention, not seen in the drawings, the roof 16 may have dimensions that require the use of a roof truss, similar to one of the roof beams 100 that reinforces two roof beams 100 that form a substantially V-shape. The roof truss and the roof beams 100 form a substantially triangular shape.

The roof 16 further includes roof internal walls 110 and roof external walls 116. Roof insulation 114 is provided between the roof internal wall 110 and the roof external wall 116. The roof internal wall 110 includes roof internal wall panels that are secured to the roof beams 100. For example, the roof internal wall panels 111 are screwed or nailed to the roof beam first lateral members 102 on which they abut. The roof internal wall panels 111 are dimensioned so as to span two adjacent roof beams 100. In some embodiments of the invention, roof reinforcement ribs 112 extend substantially outwardly from the roof internal panel 111. The roof external wall 116 includes roof external wall panels 117 that are secured to the roof reinforcement ribs 112 through screws, nails or any other suitable fastener.

Referring to FIGS. 6*a*-6*c*, internal divisions of the house 10 are supported by internal posts 14' that are secured to the floor supports 226. For example, the internal posts 14' are supported by internal posts supporting bracket 382 that include an internal post support bracket first plate 384, a substantially opposed and parallel internal post supporting bracket second plate 386 and a spacing plate 388 extending therebetween substantially perpendicularly thereto. Therefore, the internal post supporting bracket 382 is substantially U-shaped.

Internal division panels (not shown in the drawings) are securable to the internal posts 14' similarly in the manner in which the internal wall panels 240 are secured to the posts 14. Assembly of the internal division panels will therefore not be described in further details herein.

Internal post supporting brackets 282 space the internal post 14' and the footboard support 398 by a distance allowing to insert therebetween the tiles 236.

Referring to FIG. 4, assembling members 28 are usable to position the posts 14 and adjust their attitude so that they are substantially vertical. The assembling members 28 include post positioning members 400 and post attitude securing members 420. Post positioning members 400 are inserted between adjacent posts 14 when securing the posts 14 to the footing 500. The post positioning members 400 ensure that the posts 14 are all spaced apart by a predetermined distance, this predetermined distance ensuring that all the components of the house 10 are securable to the posts 14 without requiring fine adjustments or cutting. The post attitude securing members 420 are secured to the posts 14 to ensure that the posts 14 are substantially vertical. Therefore, the posts 14 are all substantially parallel to each other so as to allow the attachment of the different components of the house 10 at any height above the ground without requiring fine adjustments or cutting.

The post positioning members 400 are substantially elongated and define positioning member first and second ends 402, 404. Post positioning member attachments 406 are located substantially adjacent the post positioning member first and second ends. The post positioning member attachments 406 are spaced apart by a predetermined distance. For example, the post positioning member attachments 406 include hooks 78 that are insertable into the attachment apertures 72.

The post attitude securing members are substantially elongated and define post attitude securing member first and second ends 422 and 424. Post attitude securing member attachments 426 are located substantially adjacent the post attitude securing first and second ends. Typically. The post attitude securing members are used pairwise so that they are crossed relatively to each other. When crossed, the post attitude securing members define a predetermined angle relatively to the posts 14. The post attitude securing member attachments 426 are configured and sized so that the post attitude securing members are secured to the posts 14 in a crossed configuration. For example, the post attitude securing members are oriented at substantially 45 degrees relatively to the posts 14.

Referring to FIGS. 14*a*-14*d*, the windows 22 and the doors 24 are secured between adjacent posts 14 using attachment brackets 600. The attachment brackets 600 are securable to the windows and doors 22 and 24 in any suitable manner, for example, using screws. The attachment brackets 600 include an attachment bracket first plate 602 and an attachment bracket second plate 604 extending substantially perpendicularly therefrom. The attachment brackets second plates 604 include hooks 78 extending substantially perpendicularly therefrom and parallel to the attachment bracket first plate 602 for securing the windows 22 and the doors 24 to the posts 14.

The above-described components are usable to assemble the house 10 as described hereinbelow. The reader skilled in the art will readily appreciate that some of the steps described hereinbelow may be performed in alternative sequences. Therefore, unless otherwise specified or otherwise claimed, these steps may be performed in an order different from the order in which they are mentioned hereinbelow.

First, the footing 500 is poured in a conventional manner. Then, the template 538 is used to mark the position of the apertures into which the reinforcement rods 543 are to be inserted. Afterwards, the template 538 is removed from the footing 500 and the rods 543 are inserted into the footing 500.

Subsequently, the posts 14 are assembled and the brackets that are used to attach different components of the house 10 to the posts 14 are secured in their proper location onto the posts 14. Afterwards, the posts 14 are positioned at suitable locations onto the footing 14 using the post supporting brackets 544. The post supporting brackets 544 are secured to the footing 500 using screws 554. The post supporting bracket first plates 546 are levelled by inserting the screws 554 over a suitable distance into the footing 500. Then, the grout 556 is used so that the post supporting brackets 544 are maintained in a substantially horizontal orientation.

Afterwards, the posts 14 are secured to the post supporting brackets 544. In embodiments of the invention wherein post positioning members 400 are used, the post positioning members 400 are used to fine tune the position of the posts 14 relatively to the footing 500. In these embodiments, the post positioning members 400 are positioned between adjacent posts 14 prior to securing in place the posts 14. The post attitude securing members 520 are also secured to the adjacent posts 14 so that the posts 14 are substantially vertical.

After the posts 14 are positioned and supported vertically, the main and auxiliary beams 200 and 212 are attached to the posts 14 and to each other. Afterwards, if desired, scaffolding is assembled around, into or both around and into the house 10. In some embodiments of the invention, the scaffolding is attachable to the posts 14 using brackets. However, in alternative embodiments of the invention, any other suitable scaffolding is used. FIG. 15*a* illustrates an example of a house at this stage of assembly.

Afterwards, the floor support 226 and the stairs are secured to the posts 14 and to the main and auxiliary beams 200 and 212. If required, temporary floors are secured to the floor supports 226 so that work may be performed in the house 10 without damaging the tiles 236. Then, installation of the internal wall panels 340 and of the divisions of house 10 may proceed as described hereinabove.

To build the roof 16, the roof beams 100 are assembled and secured to each other to form the shape of the roof 16. The roof beams 100 are then secured to the posts 14 and assembly of the rest of the roof 16 may proceed to obtain the roof 16 described hereinabove. If desired, insulation 114 is inserted between the roof internal wall panels 111 and the roof external wall panels 117.

Afterwards, the windows 22 and doors 24 may be assembled and installed onto the posts 14. Insulation is provided between the internal wall panels 300 that are located substantially adjacent the foundation wall 502 and insulation is inserted between the posts 14, and over the posts 14 at locations substantially adjacent the location at which the foundation wall 502 will be found after being poured. Also, insulation is provided to insulate the external walls of the house along their entire height.

After insulation is completed, for example by using polyurethane foam, the bracing 528 is positioned, if required, onto the posts 14 along with the framing 522. Subsequently, the foundation wall 502 is poured and left to cure. The external wall panels 340 are then secured to the posts 14. In some embodiments of the invention, the external wall panel attachment linking members 356 are used as described hereinabove to finely adjust a vertical position of the external wall panels 340 and to bias the external wall panels 340 towards each other. Finally, the framing 522 and bracing 528 is removed and the external and internal finishing panels 366 and 368 are assembled.

Installation of electrical components and of plumbing in the house 10 is performed at any suitable time during the assembly of the house 10. Preferably, plumbing and electrical components are installed before all internal panels and floor tiles 236 are in place. However, it is also within the scope of the invention to completely assemble the structure of the house 10 and to remove internal wall panels 300 and tiles 236 at suitable locations to provide access to the spacing between the floors or between the walls panels as required to install plumbing or electricity.

The assembling members 28 ensure that the house may be assembled without requiring any measurements to be taken. Furthermore, in some embodiments of the invention, most of the components of the house 10 are relatively easy to remove to access the space between the internal and external walls or to add accessories to the house 10. For example, cupboards may be manufactured that include hooks 78 and that are therefore attachable into the house 10 using attachment brackets that attach the cupboards to the hooks 78. When a cupboard needs to be added to the house 10, an intended user may simply remove an internal wall panel 300 at the location where the cupboard is to be installed and, thereafter, install the cupboard.

Synergistic effects between the different components of the house 10 allow assembling the house 10 relatively easily, even by an inexperienced user. Also, the different components of the house 10 synergistically allow to assemble a relatively solid house.

Although the present invention has been described hereinabove by way of preferred embodiments thereof, it can be modified, without departing from the spirit and nature of the subject invention as defined in the appended claims.

What is claimed is:

1. A kit for building an exterior wall of a modular building structure, said kit comprising:

at least two substantially elongated posts, each post defining a longitudinal axis; and a wall panel configured to be installed vertically on said at least two posts, said wall panel including a wall panel first attachment and a wall panel second attachment, said wall panel first and second attachments each including:

an L-shaped wall panel attachment linking member including a first segment (358) extending substantially outwardly from said wall panel and a second segment (360) extending substantially perpendicularly from said first segment;

an attachment bracket post attachment portion configured to be attached to at least one of said at least two posts;

a wall panel attachment bracket comprising a groove configured to receive the second segment therein and configured to spacingly attach the wall panel to the at least one of the at least two posts;

and an attachment bracket spacing section joining and extending between said wall panel attachment bracket and said attachment bracket post attachment portion;

wherein said wall panel attachment linking member is configured to be selectively moved relative to said wall panel attachment bracket in a direction substantially parallel to said post longitudinal axes when said wall panel attachment bracket is attached to said post, said panel attachment linking member configured to be moved between a first panel attachment linking member position and a second panel attachment linking member position.

2. The kit as defined in claim 1, wherein each of said at least two posts defines a post outer surface and includes a post passageway extending substantially longitudinally therethrough, said attachment bracket post attachment portion including an attachment aperture extending between said post outer surface and said post passageway for receiving said wall panel first and second attachments.

3. The kit as defined in claim 2, wherein the attachment aperture includes a plurality of attachment apertures extending between said post outer surface and said post passageway, each one of said plurality of attachment apertures being substantially longitudinally spaced apart from each other, each one of said plurality of attachment apertures being provided for selectively receiving one of said wall panel first and second attachments, each one of said plurality of attachment apertures defining a respective attachment aperture periphery.

4. The kit as defined in claim 3, wherein said plurality of attachment apertures, and said wall panel first and second attachments are configured and sized so that said wall panel first and second attachments are each reversibly attachable to said plurality of attachment apertures.

5. The kit as defined in claim 4, wherein said wall panel first and second attachments each include a respective hook, said hook being insertable into said plurality of attachment apertures.

6. The kit as defined in claim 5, wherein each one of said plurality of attachment apertures is substantially elongated and oriented substantially longitudinally relatively to at least one of said two posts.

7. The kit as defined in claim 6, wherein said hook is substantially L-shaped and includes a hook first portion and a hook second portion extending substantially perpendicularly from said hook first portion, said hook first portion being positioned into said post passageway and said hook second portion extending through at least one of said plurality of attachment apertures when said hook is inserted into said attachment aperture.

8. The kit as defined in claim 7, wherein said hook is locked into said attachment aperture through a gravitational force pulling onto said wall panel, thereby abutting said hook second portion against said attachment aperture periphery.

9. The kit as defined in claim 3, wherein said post includes a plurality of attachment apertures positioned at substantially similar longitudinal positions and substantially circumferentially spaced apart from each other.

10. The kit as defined in claim 3, further comprising a post attitude securing member removably attachable simultaneously to said two posts, said post attitude securing member being configured and sized so that when said post attitude securing member is attached to said two posts, said two posts are parallel to each other.

11. The kit as defined in claim 2, wherein said post includes two substantially U-shaped members positioned substantially parallel to each other so as to define said post passageway and a post member attachment attaching said two substantially U-shaped members to each other.

12. The kit as defined in claim 2, wherein said post includes an auxiliary aperture extending between said post outer surface and said post passageway.

13. The kit as defined in claim 2, wherein said wall panel first and second attachments each include the wall panel attachment bracket attachable to said attachment section and the wall panel attachment linking member reversibly attachable to said wall panel attachment bracket and extending from said wall panel body.

14. The kit as defined in claim 1, wherein said linking member first segment is reversibly attachable to said wall panel attachment bracket.

15. The kit as defined in claim 1, wherein said wall panel attachment bracket is configured and sized so that said wall panel body and said posts are in a spaced apart relationship relatively to each other when said wall panel is attached to said posts.

16. The kit as defined in claim 1, further comprising an insulation material installed in the space between the wall panel and the post.

17. The kit as defined in claim 1, wherein said wall panel comprises concrete.

18. The kit as defined in claim 1, wherein said attachment bracket post attachment portion, said wall panel attachment bracket and said attachment bracket spacing section each defines a plan which is different to the two other plans.

19. The kit as defined in claim 1, wherein said attachment bracket post attachment portion, said wall panel attachment bracket and said attachment bracket spacing section each defines a plan which is perpendicular to the two other plans.

20. The kit as defined in claim 1, wherein when the wall panel is installed outwardly spaced apart on said at least two posts, said attachment bracket spacing section provides a space between said wall panel and each of said at least two posts.

* * * * *